US010220987B2

(12) United States Patent
Robinson et al.

(10) Patent No.: US 10,220,987 B2
(45) Date of Patent: Mar. 5, 2019

(54) HELMET DRINK LID

(71) Applicants: Todd Robinson, Washington, DC (US); Jason Robinson, Apex, NC (US)

(72) Inventors: Todd Robinson, Washington, DC (US); Jason Robinson, Apex, NC (US)

( * ) Notice: Subject to any disclaimer, the term of this patent is extended or adjusted under 35 U.S.C. 154(b) by 0 days.

(21) Appl. No.: 15/367,107

(22) Filed: Dec. 1, 2016

(65) Prior Publication Data

US 2017/0233154 A1 Aug. 17, 2017

Related U.S. Application Data

(60) Provisional application No. 62/242,992, filed on Dec. 1, 2015.

(51) Int. Cl.
*B65D 47/06* (2006.01)
*B65D 51/24* (2006.01)

(52) U.S. Cl.
CPC ..... *B65D 47/06* (2013.01); *B65D 51/245* (2013.01)

(58) Field of Classification Search
CPC ..... A47G 19/22; A47G 19/2227; A47G 19/2266; A47G 19/2211; A47G 19/2222; B65D 47/06; B65D 51/24; B65D 51/245; B65D 81/36; B65D 81/366; B65D 2231/022; B65D 2231/06; B65D 2543/00351; B65D 2251/06
USPC ..... 206/217, 457
See application file for complete search history.

(56) References Cited

U.S. PATENT DOCUMENTS

D337,242 S * 7/1993 Steinfels, III ..... D7/514
D349,216 S * 8/1994 Steinfels, III ..... D7/623
5,511,685 A * 4/1996 Nelson ..... A47G 19/2227 220/662
D399,393 S * 10/1998 Steinfels ..... D7/515
7,845,489 B2 * 12/2010 Thompson ..... A47G 19/2227 206/217
8,511,507 B1 * 8/2013 Malik ..... B65D 81/366 220/703
8,701,907 B1 * 4/2014 Mallicoat ..... B65D 51/245 215/228
8,720,714 B2 * 5/2014 Romero ..... B67B 7/403 215/228
9,192,256 B2 * 11/2015 Robinson ..... B65D 81/366
2006/0226163 A1 * 10/2006 Redshaw ..... B65D 43/0218 220/796
2009/0057325 A1 * 3/2009 Tullio ..... A47G 23/0266 220/739
2010/0314401 A1 * 12/2010 Chucales ..... B65D 25/34 220/739
2014/0082914 A1 * 3/2014 Flores ..... A47G 19/065 220/703

* cited by examiner

*Primary Examiner* — Bryon Gehman

(57) ABSTRACT

A lid for a drinking container in the structure of a helmet is disclosed. The helmet lid includes the normal features of a helmet and also includes an annular mounting portion for engaging the rim or lip of a cup, a preformed opening in one of the panels of the lid configured for receiving a straw for drinking liquid from the container, a flap and cover for covering the preformed hole, and snap-lock mechanism portion on or near the annular mounting portion of the lid for securing the lid to the rim or lip of the cup.

1 Claim, 34 Drawing Sheets

Depicts cap without snap enclosure in back

HELMET DRINK LID

BACKGROUND

The present invention relates generally to a cap that is used in combination with a drinking container and more particularly, to a cap enabling drinking from the cup without removal of the lid.

SUMMARY OF THE INVENTION

The present invention is a lid of a container embodied as an article of headwear such as a head cap or hat. The present invention is a baseball cap for use by individuals for covering a container. The device employs a covering portion shaped for covering a container. The covering portion includes a substantially-continuous sidewall with, at least, one preformed opening for receiving a straw.

DESCRIPTION OF THE DRAWINGS

Figure 1:
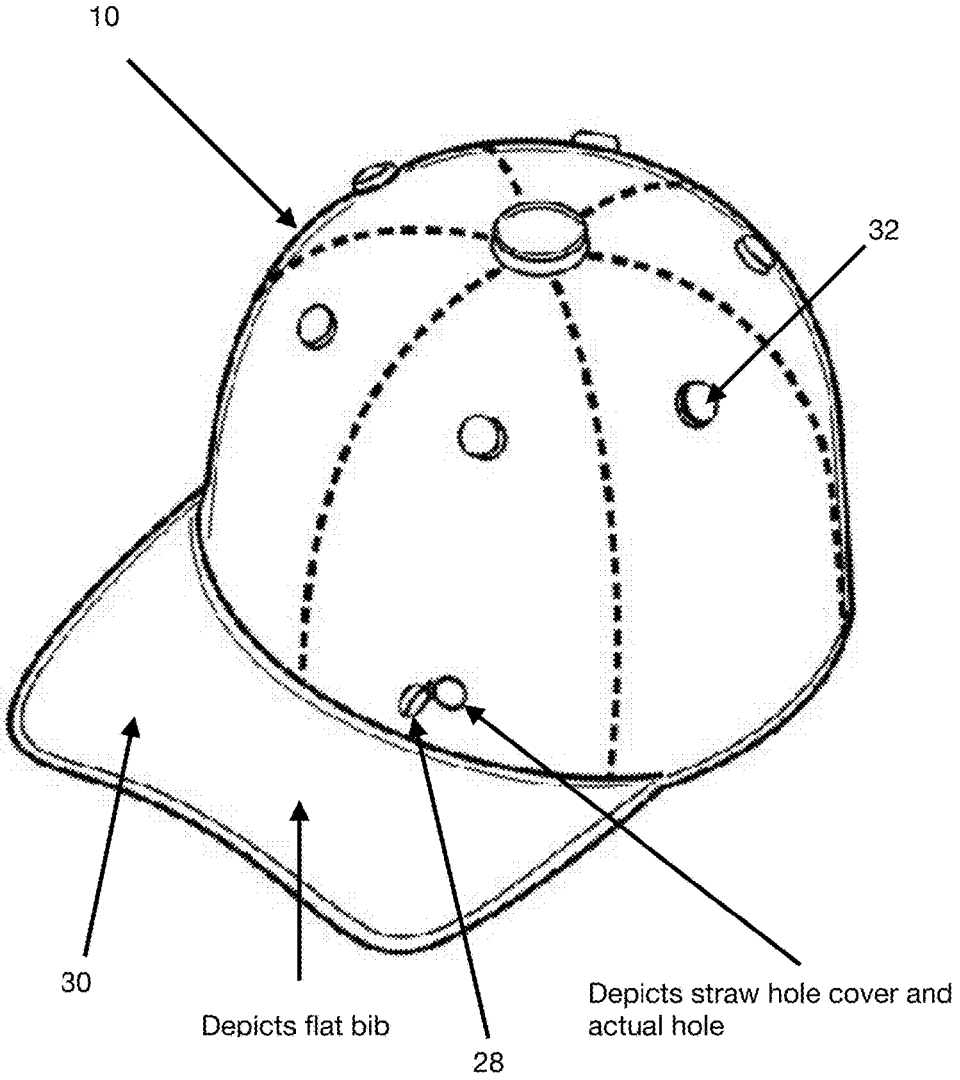

Having thus described embodiments of the invention in general terms, reference will now be made to the accompanying drawings, which are not necessarily drawn to scale, and wherein:

FIG. 1 illustrates a perspective view of a cap lid for a drinking container.

Figure 2:
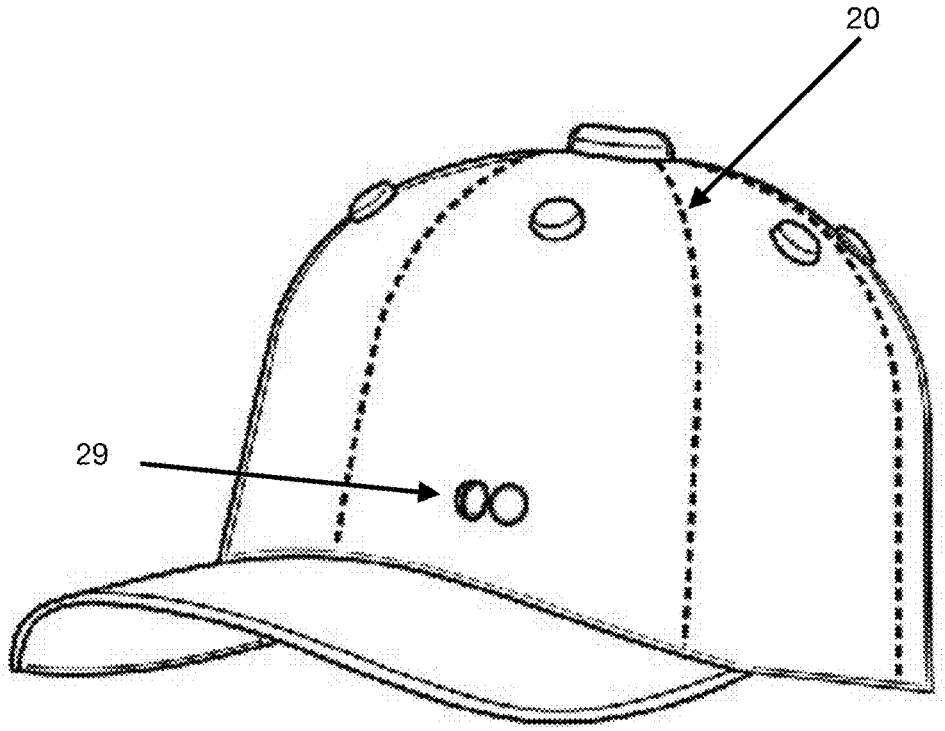

FIG. 2 illustrates a side view of a cap lid for a drinking container.

Figure 3:
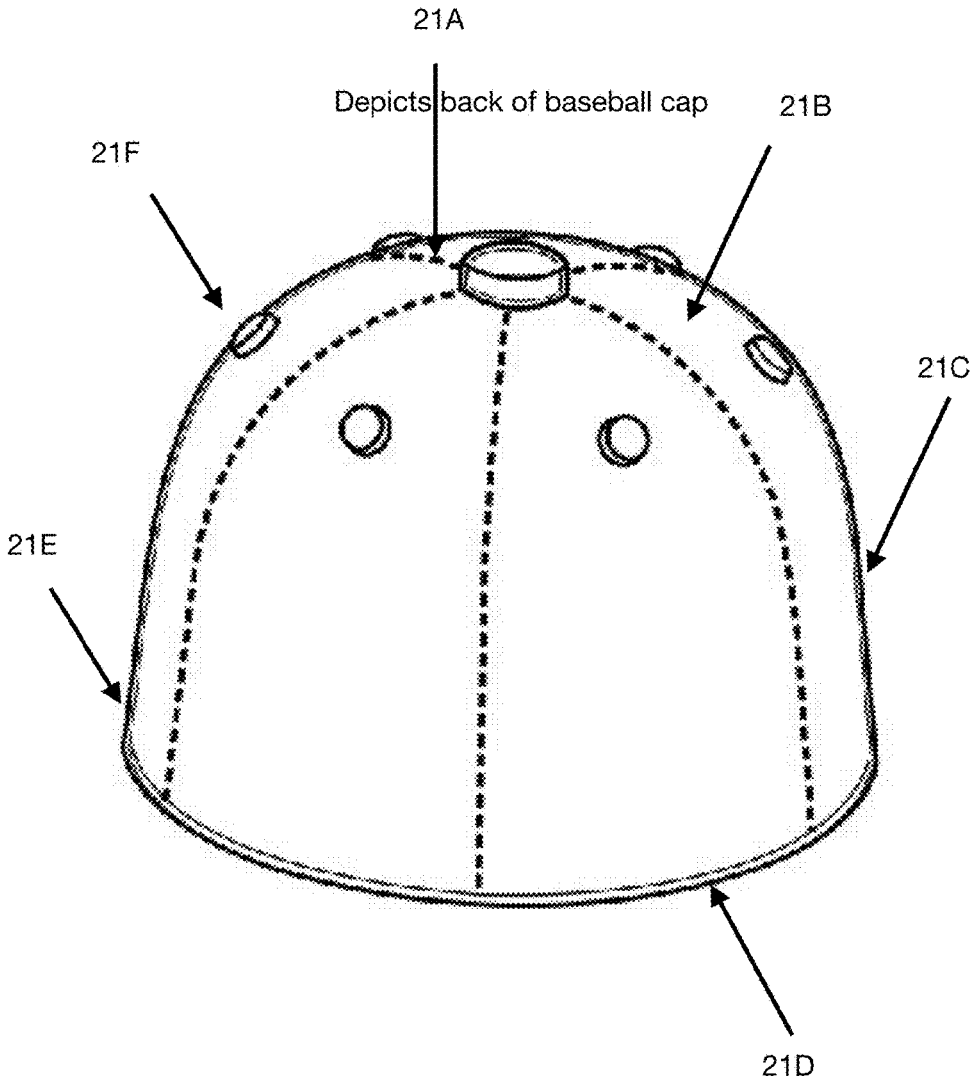

FIG. 3 illustrates a rear view of a cap lid for a drinking container.

Figure 4:
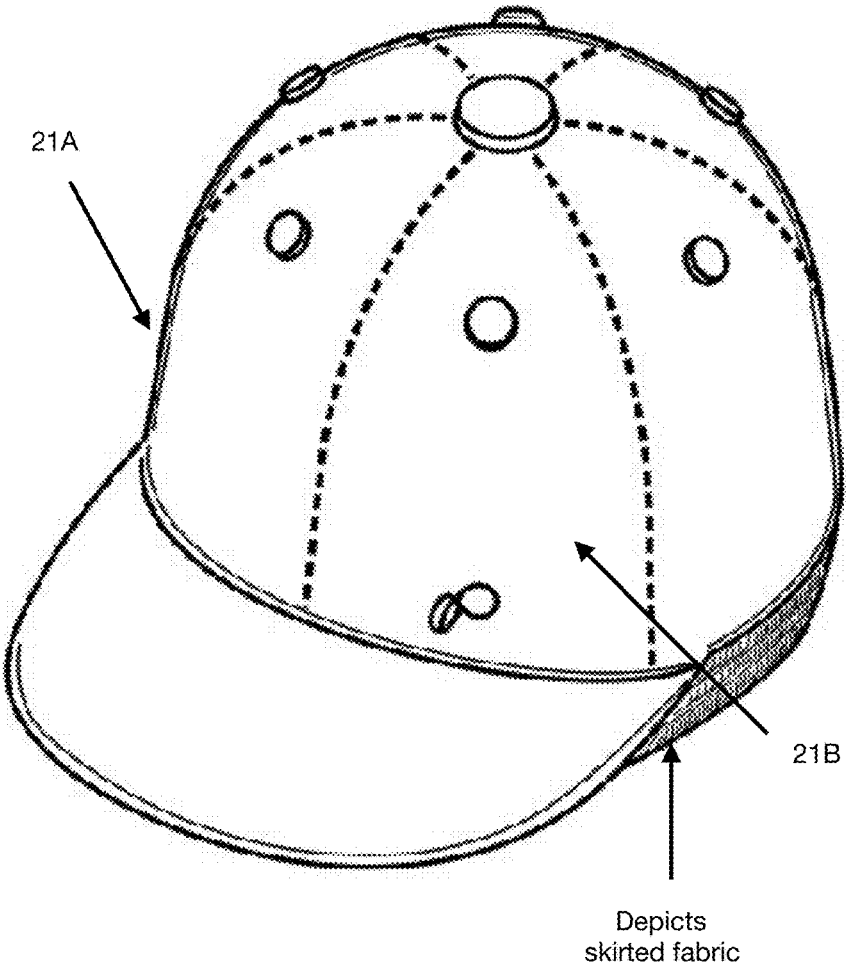

FIG. 4 illustrates a perspective view of a cap lid with a skirt for a drinking container.

Figure 5:
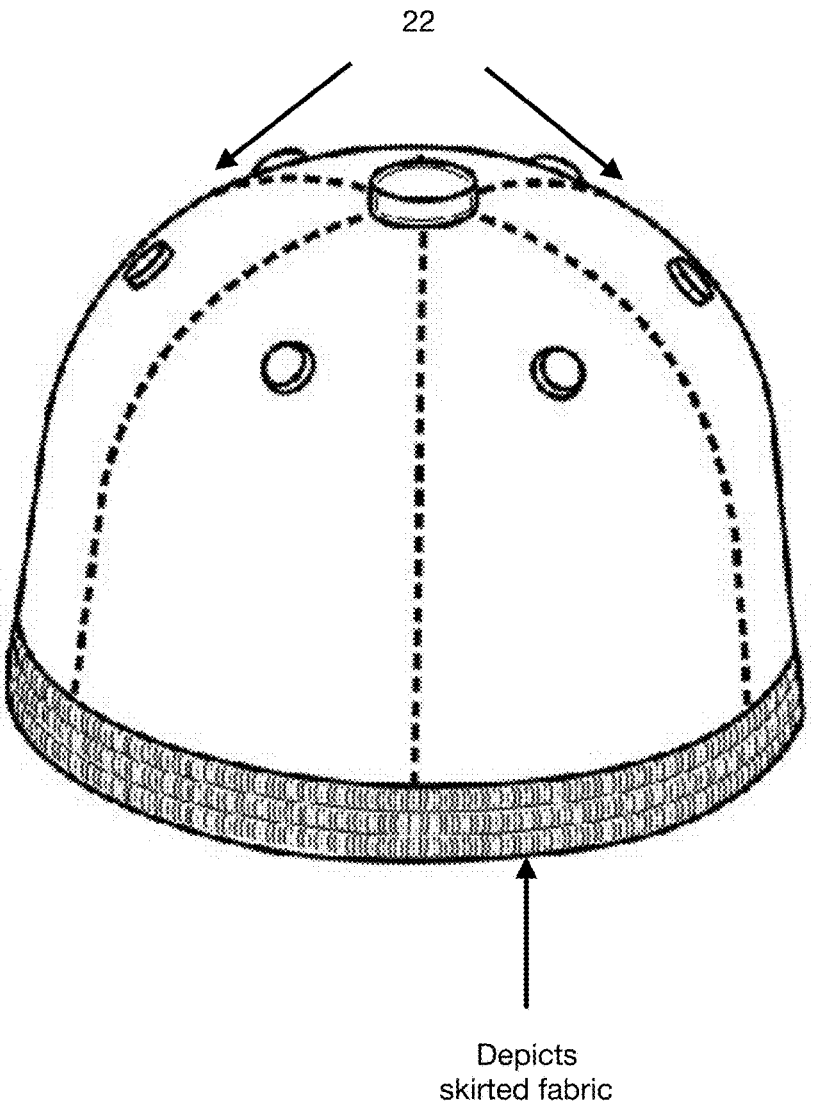

FIG. 5 illustrates a rear view of a cap lid with a skirt for a drinking container.

Figure 6:
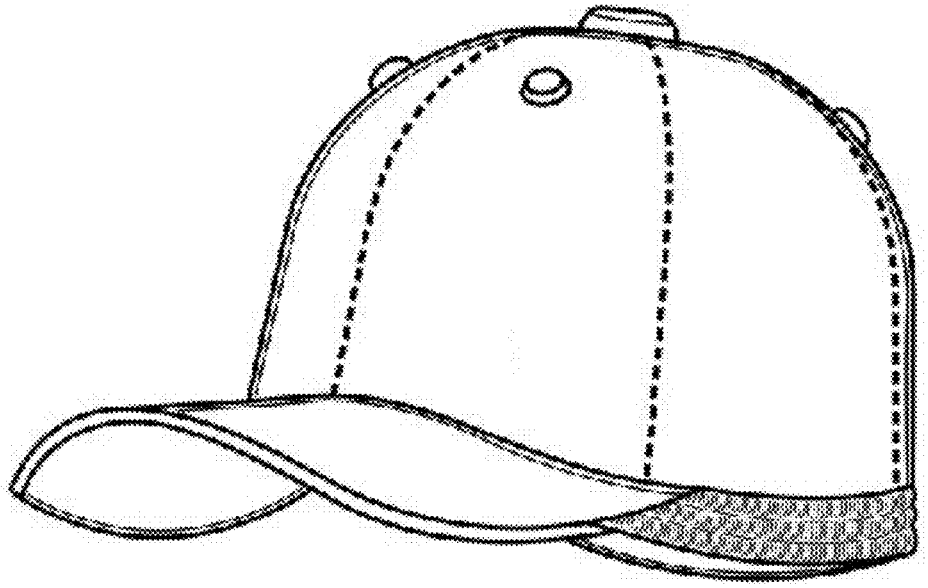

FIG. 6 illustrates a side view of a cap lid with a skirt for a drinking container.

Figure 7:
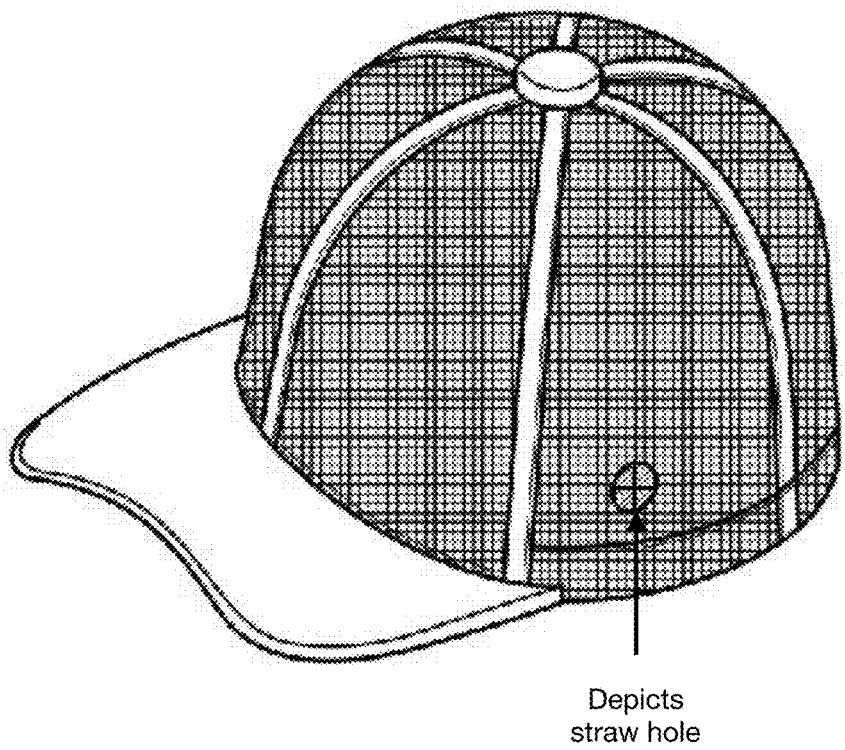

FIG. 7 illustrates a side view of a cap lid with a mesh back for a drinking container.

Figure 8:
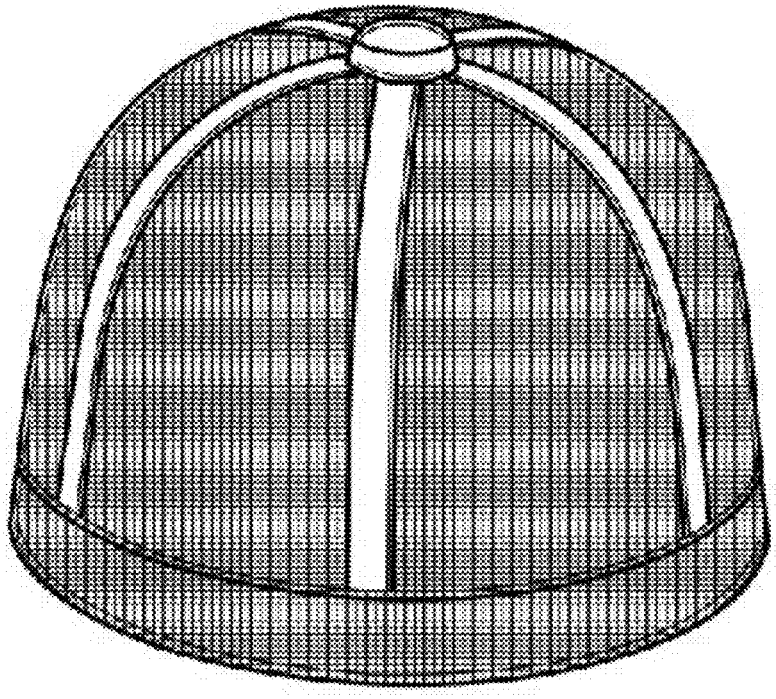

FIG. 8 illustrates is a rear view of a cap lid with a mesh back for a drinking container.

Figure 9:
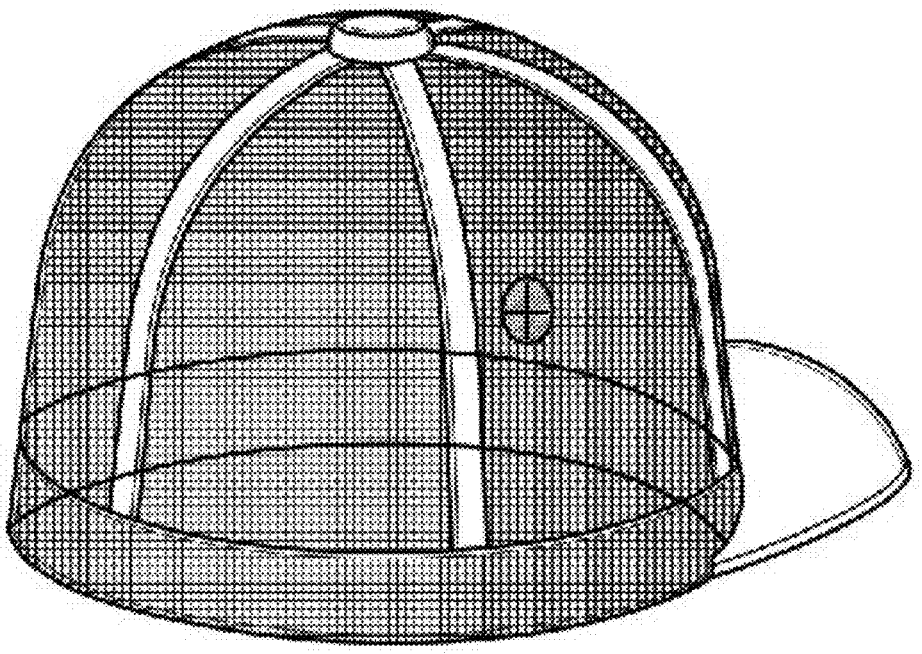

FIG. 9 illustrates is a rear angled view of a cap lid with a mesh back for a drinking container.

Figure 10:
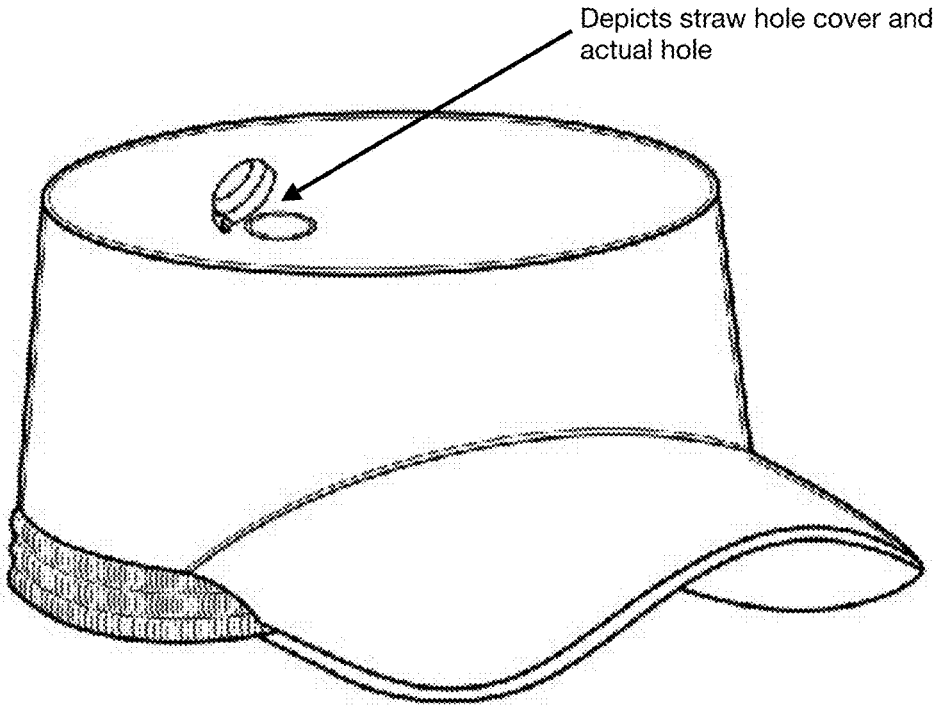

FIG. 10 illustrates is a military cap lid with a uncovered straw hole for a drinking container.

Figure 11:
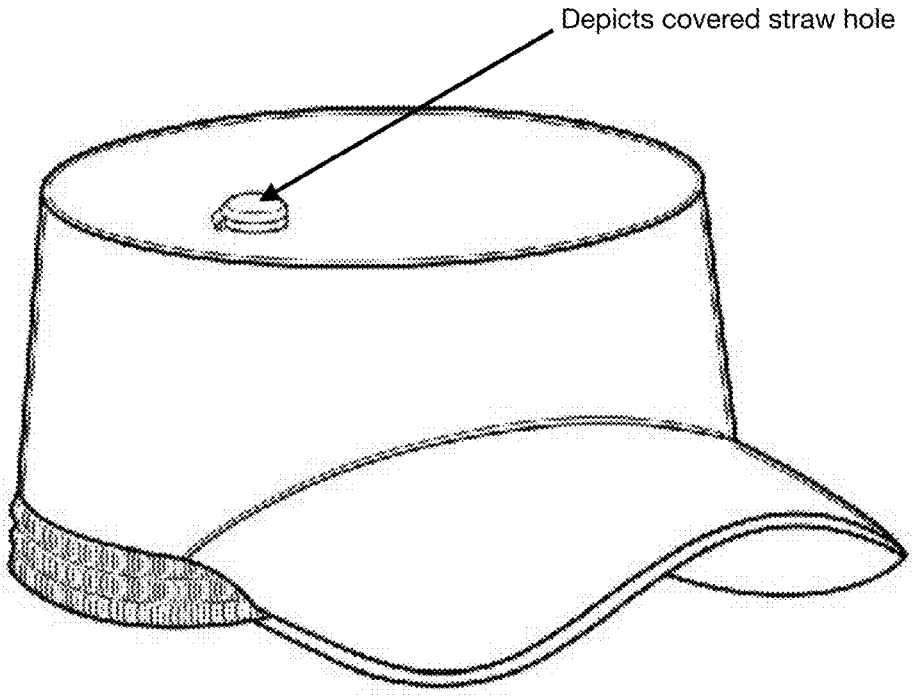

FIG. 11 illustrates is a military cap lid with a covered straw hole for a drinking container.

Figure 12:
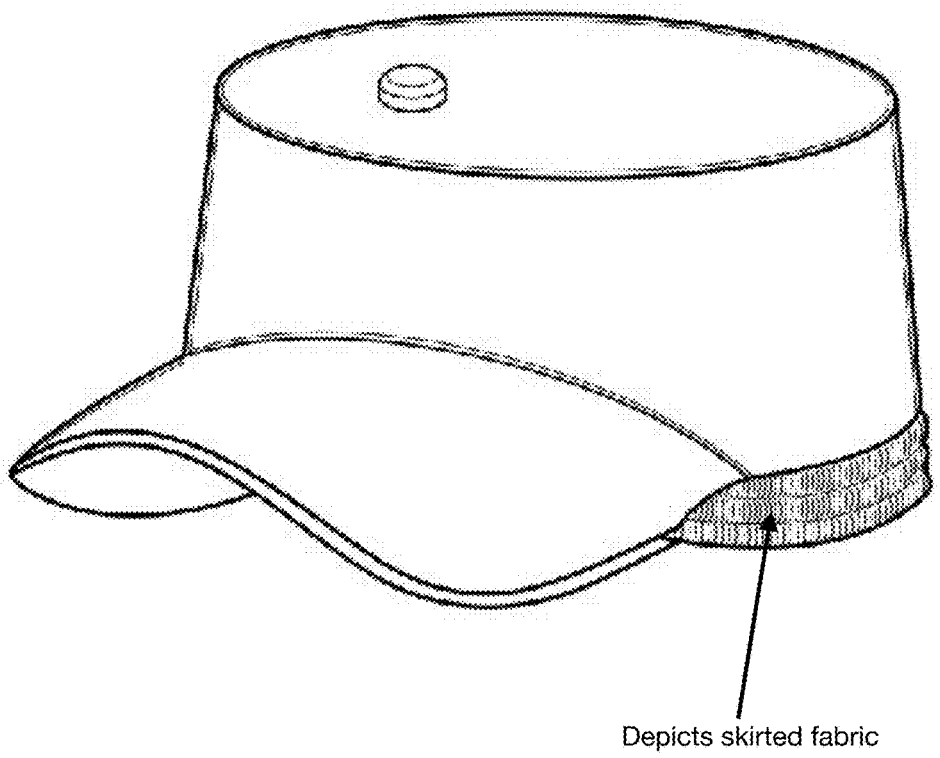

FIG. 12 illustrates is a military cap lid with an elastic portion for securing the cap lid onto a drinking container.

Figure 13:
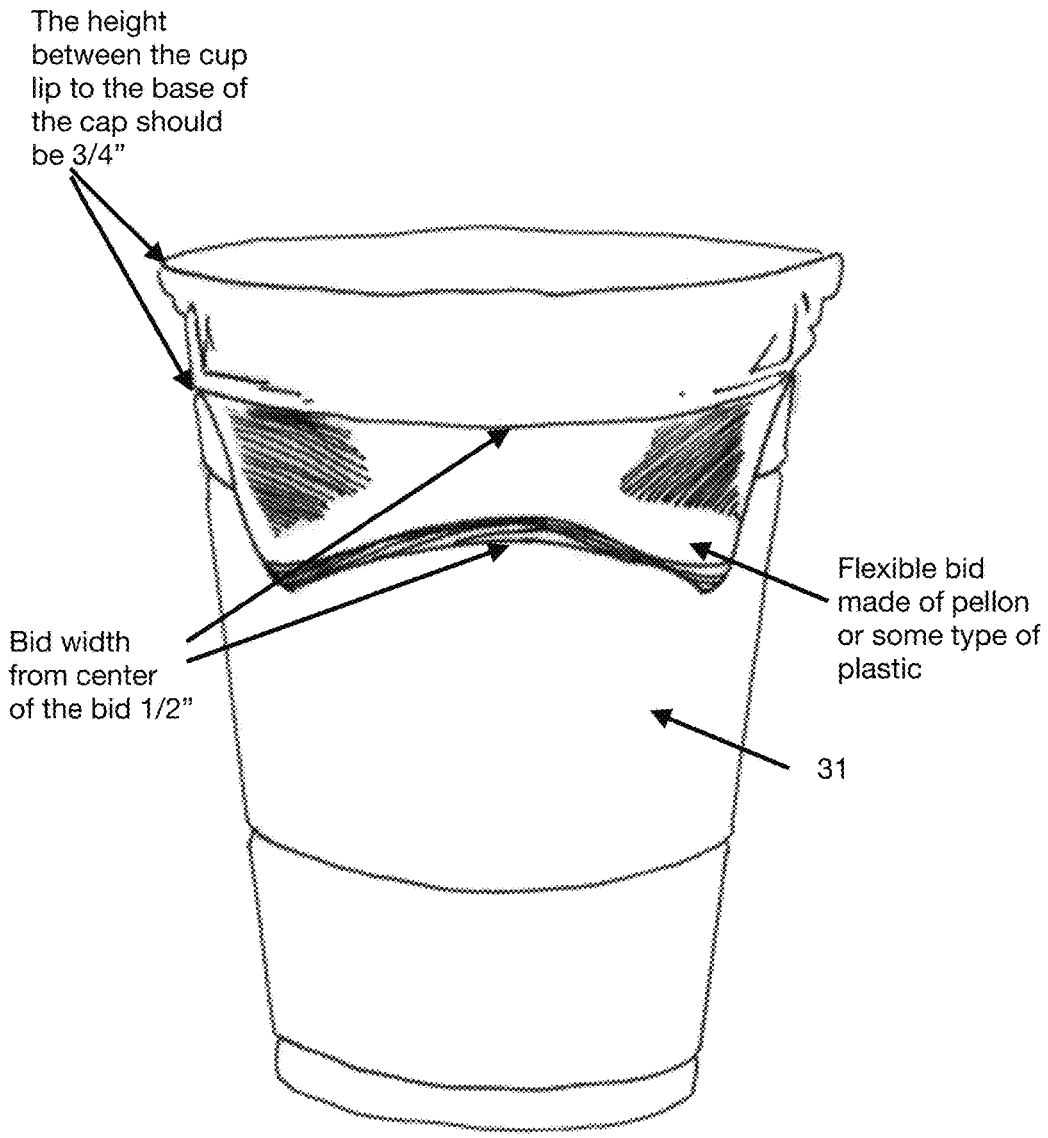

FIG. 13 illustrates is a drinking cap lid secured onto a drinking container.

Figure 14:
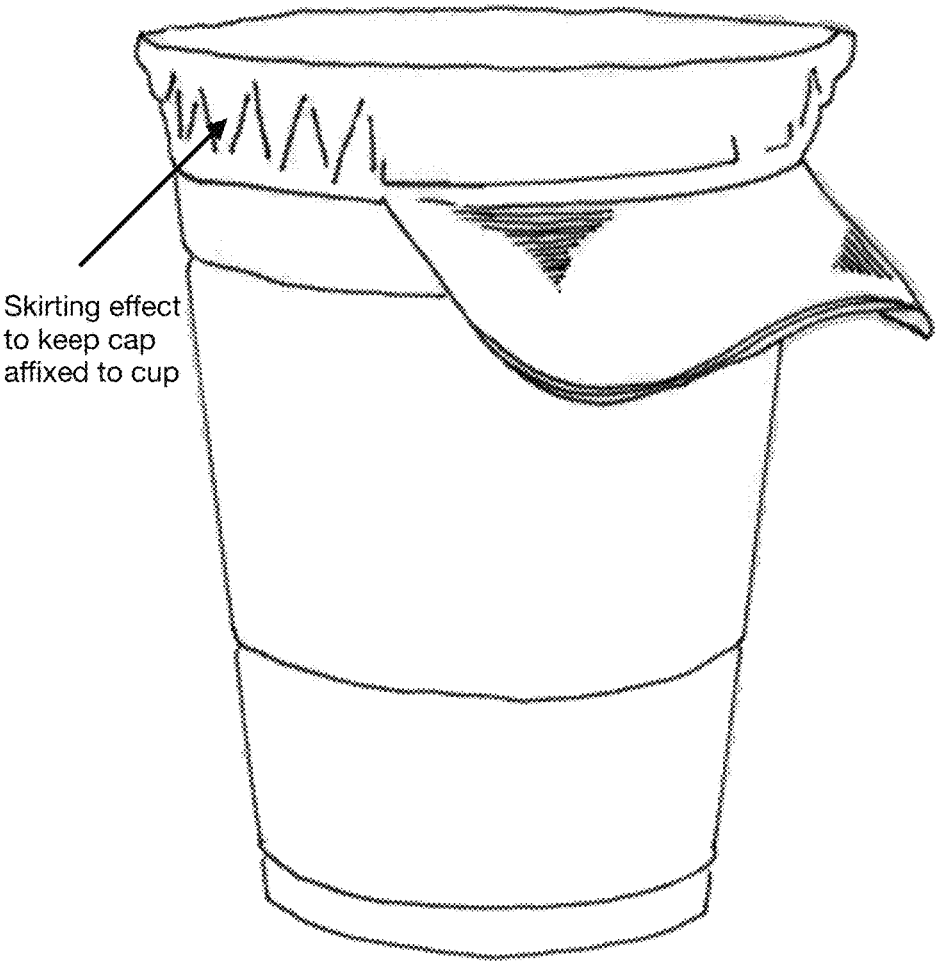

FIG. 14 illustrates is a rear view of a drinking cap lid with an elastic portions for securing the cap lid onto the drinking container.

Figure 15:
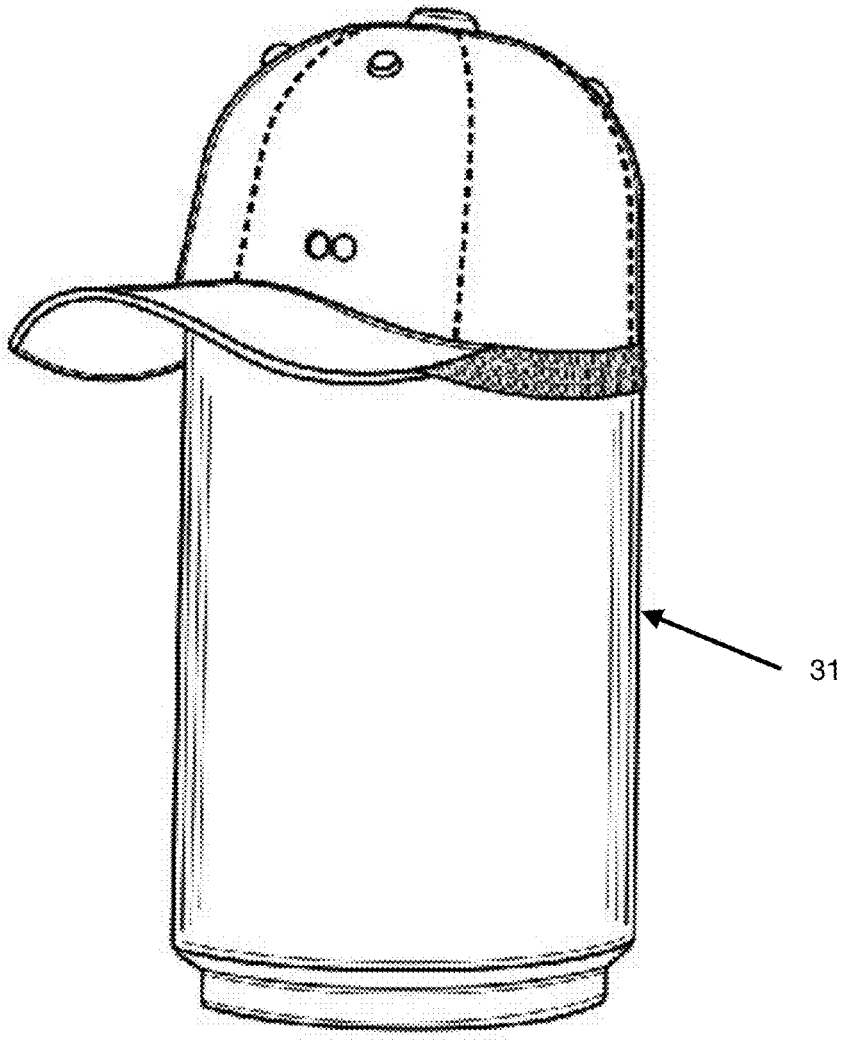

FIG. 15 illustrates is a side view of a baseball cap lid secured onto a drinking can.

Figure 16:
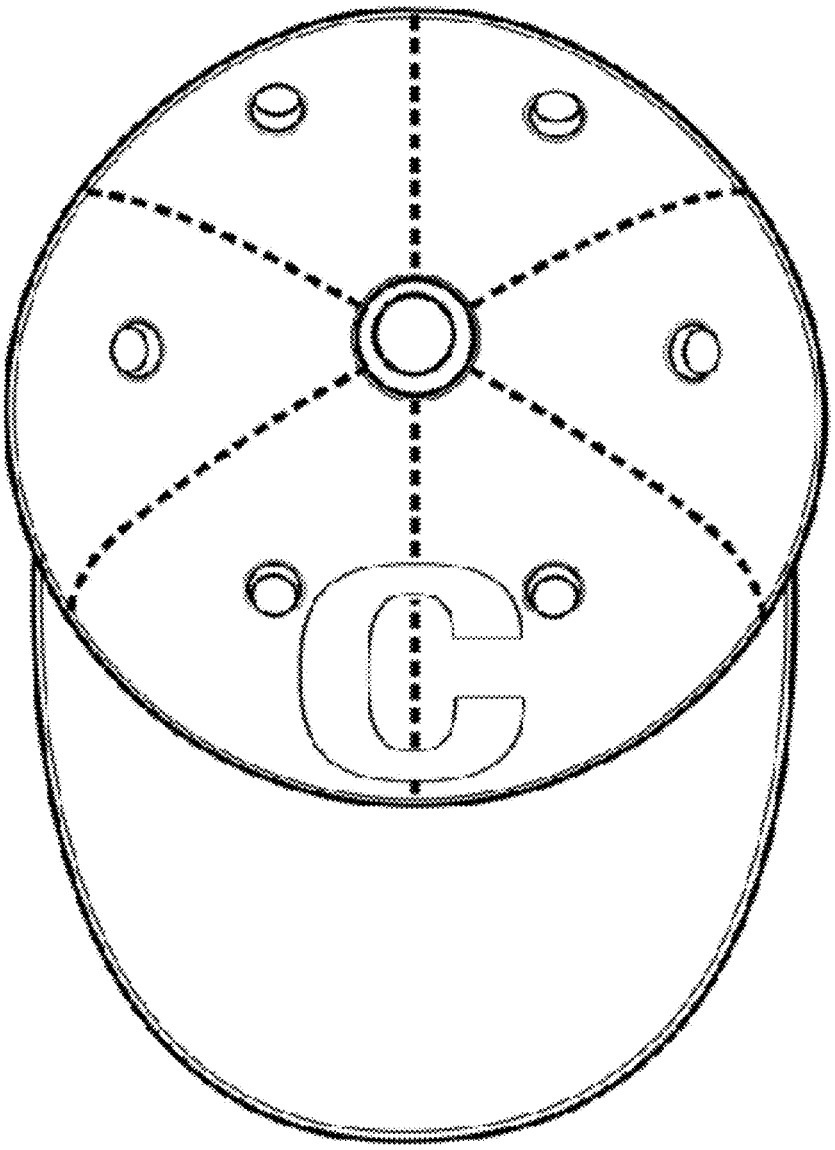

FIG. 16 illustrates is a top view of a baseball cap lid.

Figure 17:
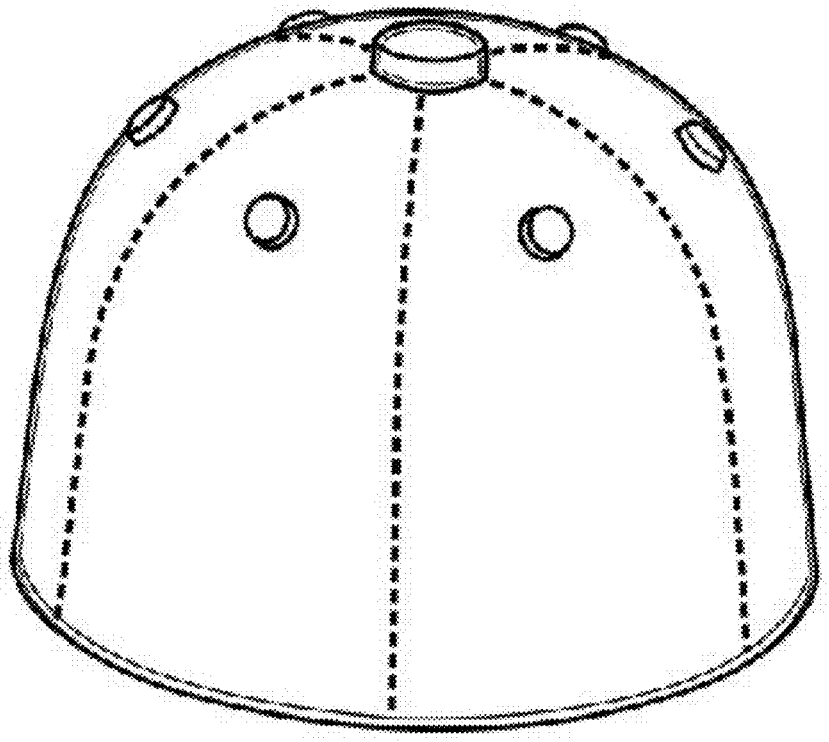

FIG. 17 illustrates is a rear view of a baseball cap lid.

Figure 18:
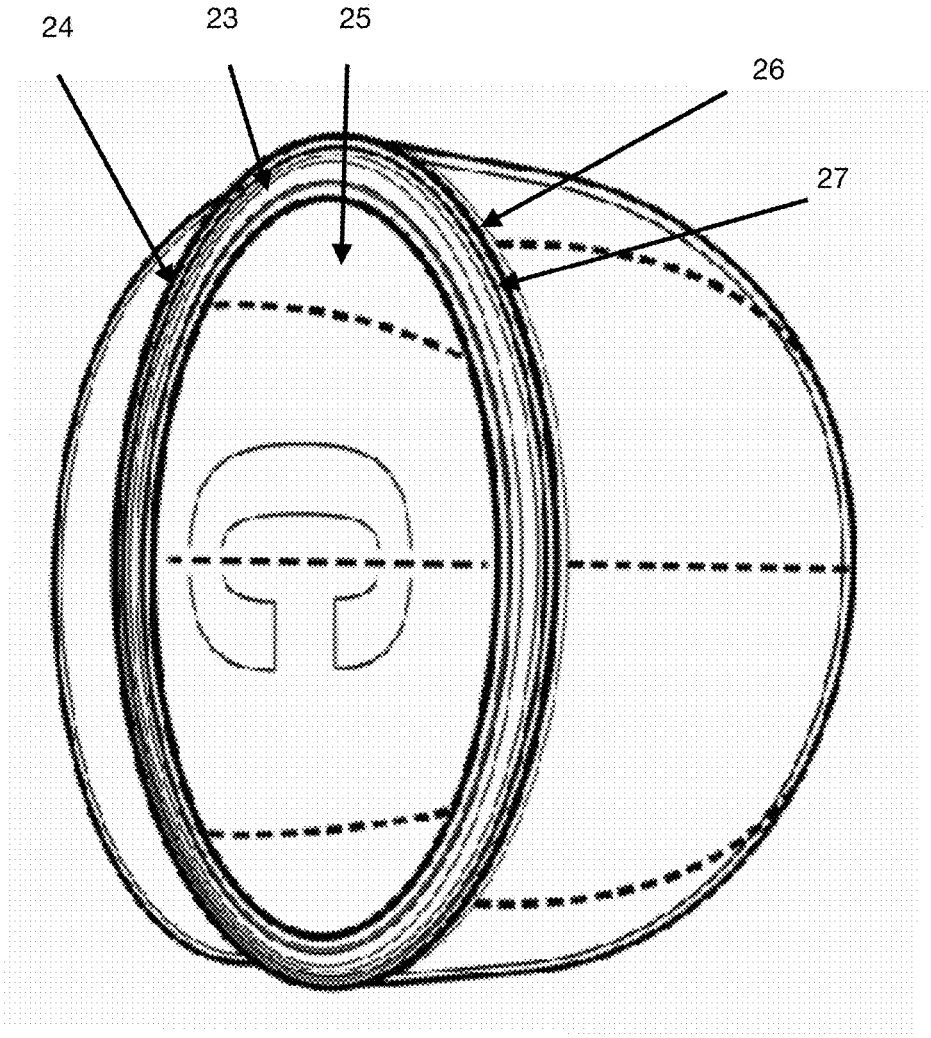

FIG. 18 illustrates is an interior view of a baseball cap lid.

Figure 19:
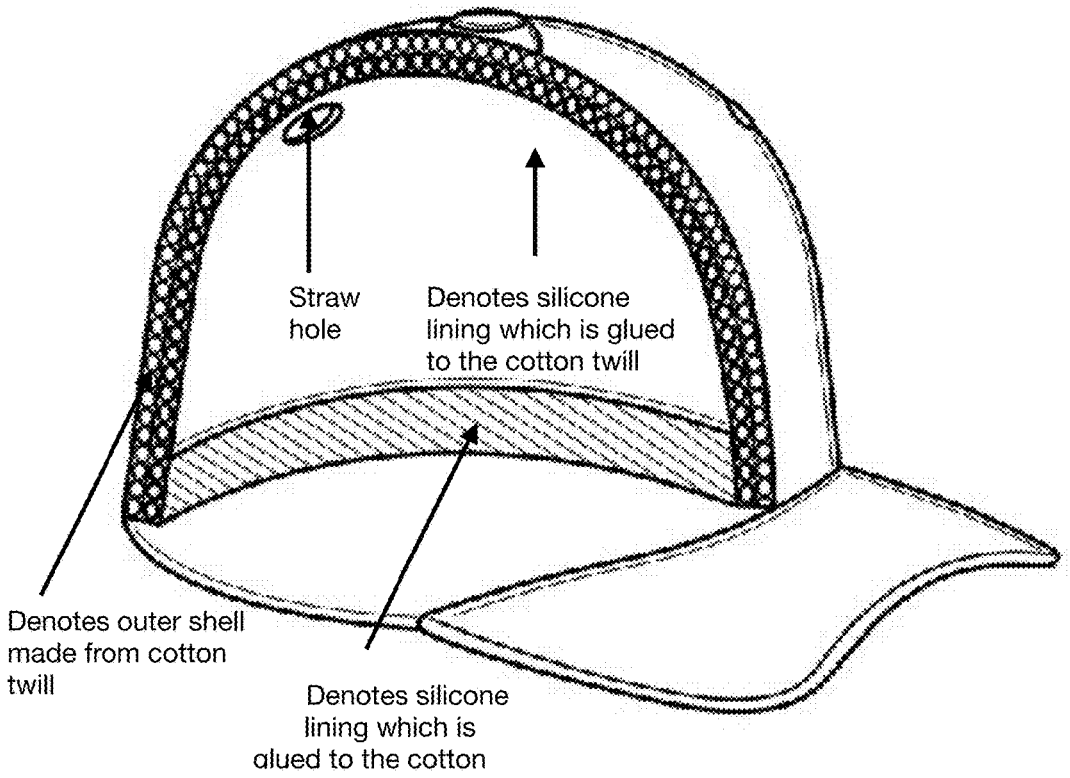
Figure 20:
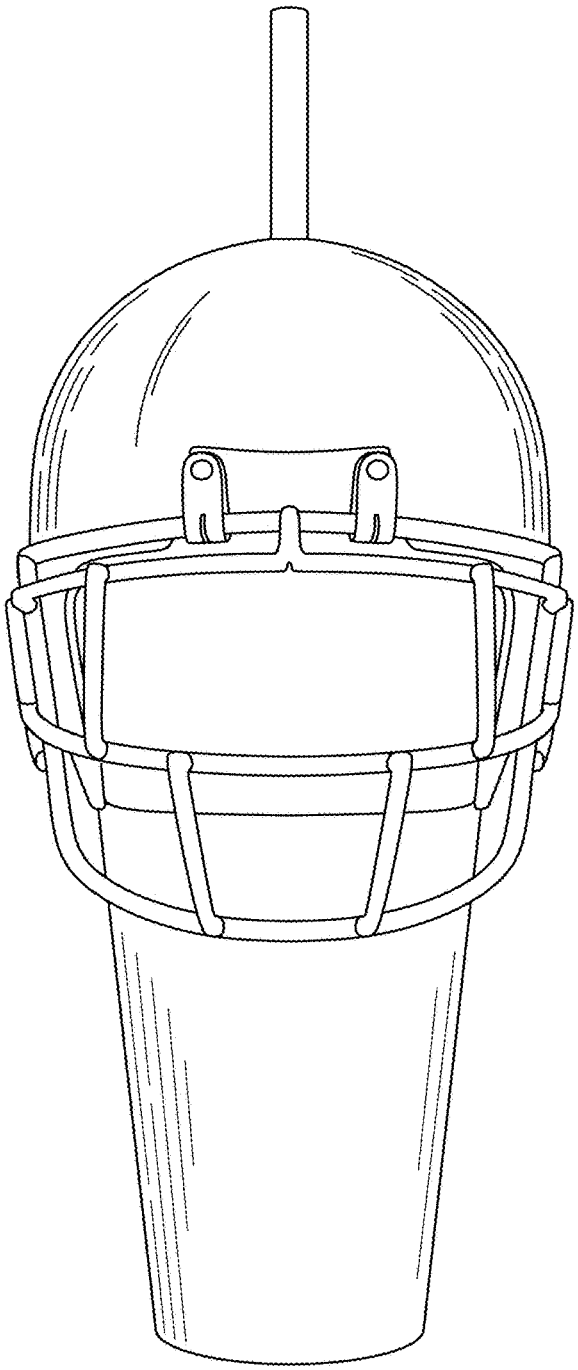
Figure 30:
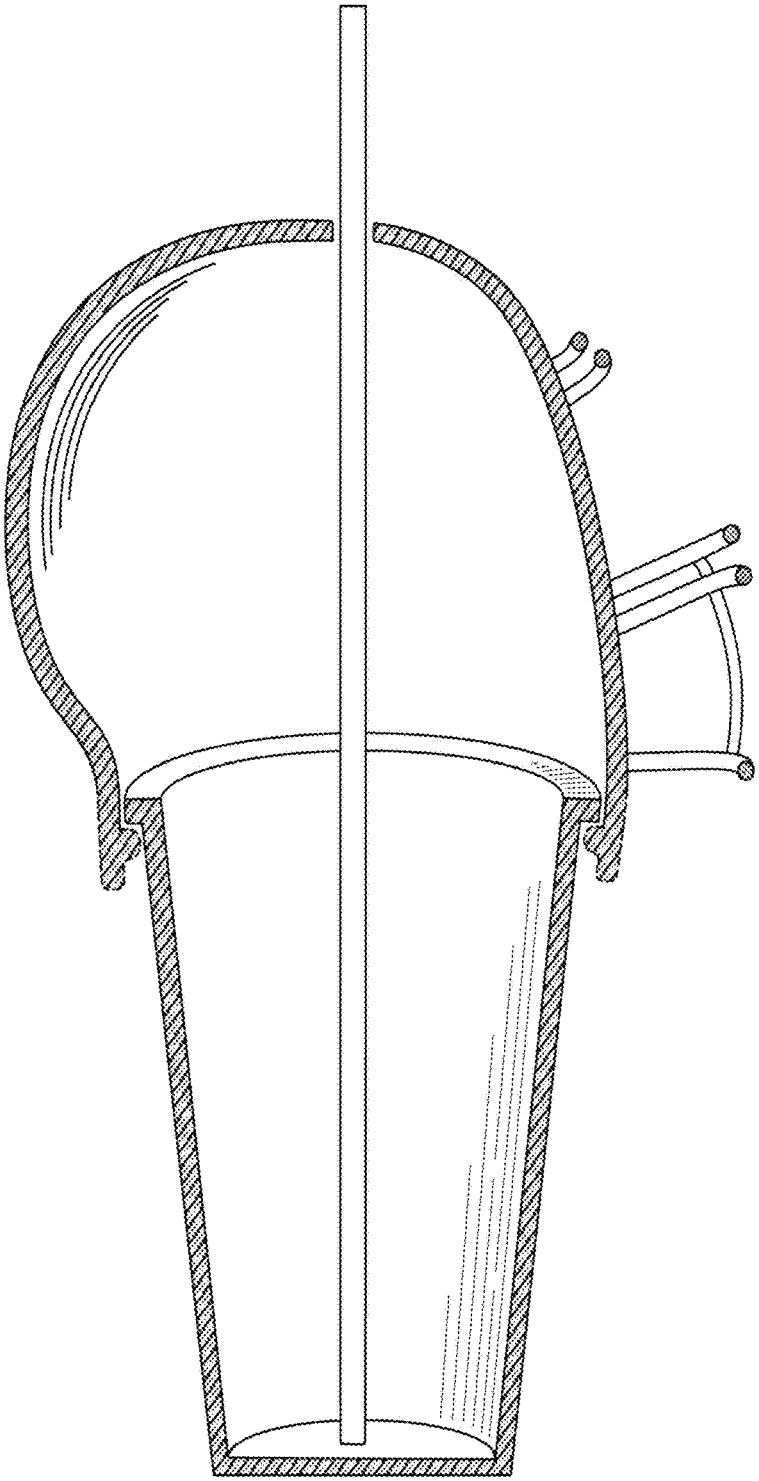
Figure 31:
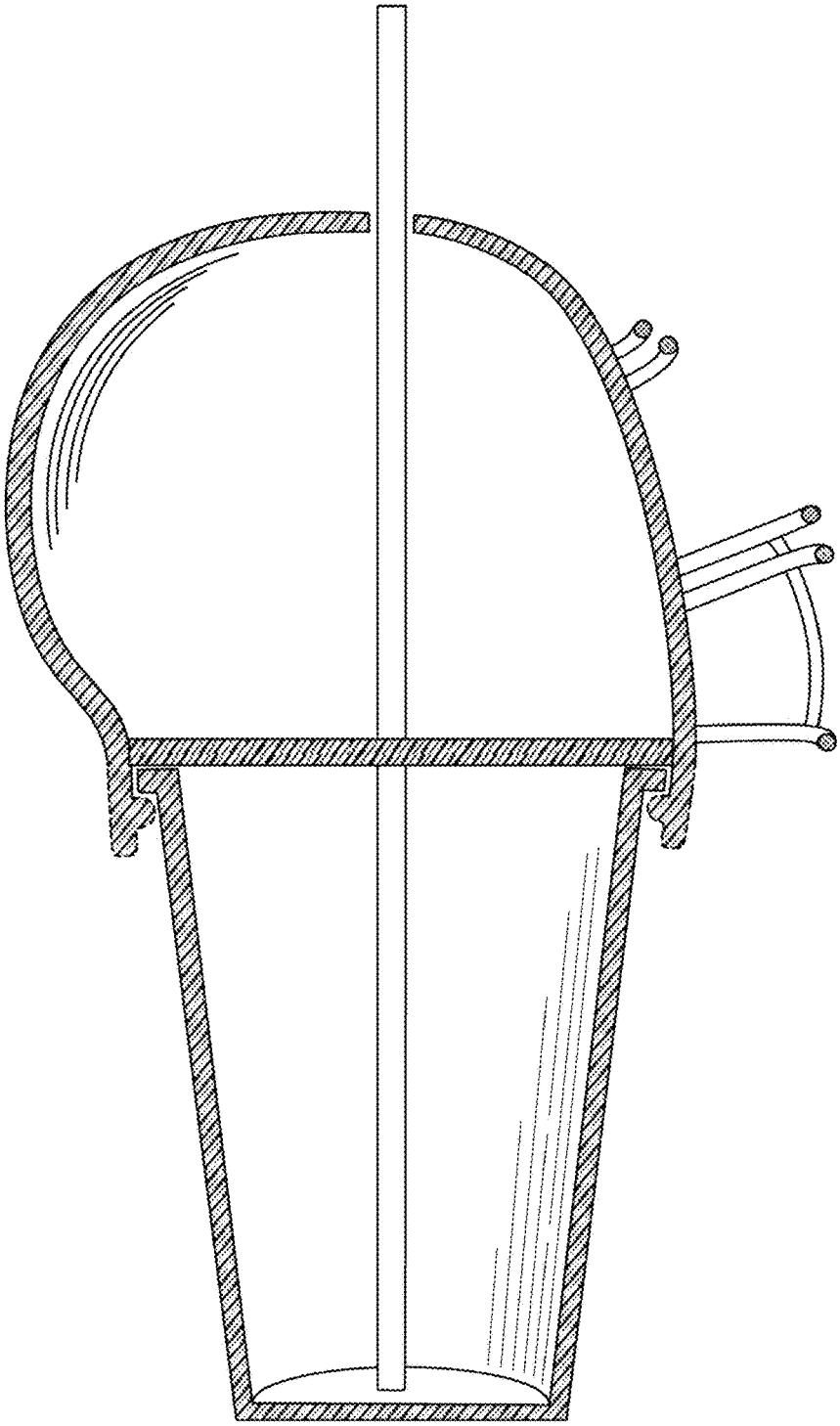
Figure 23:
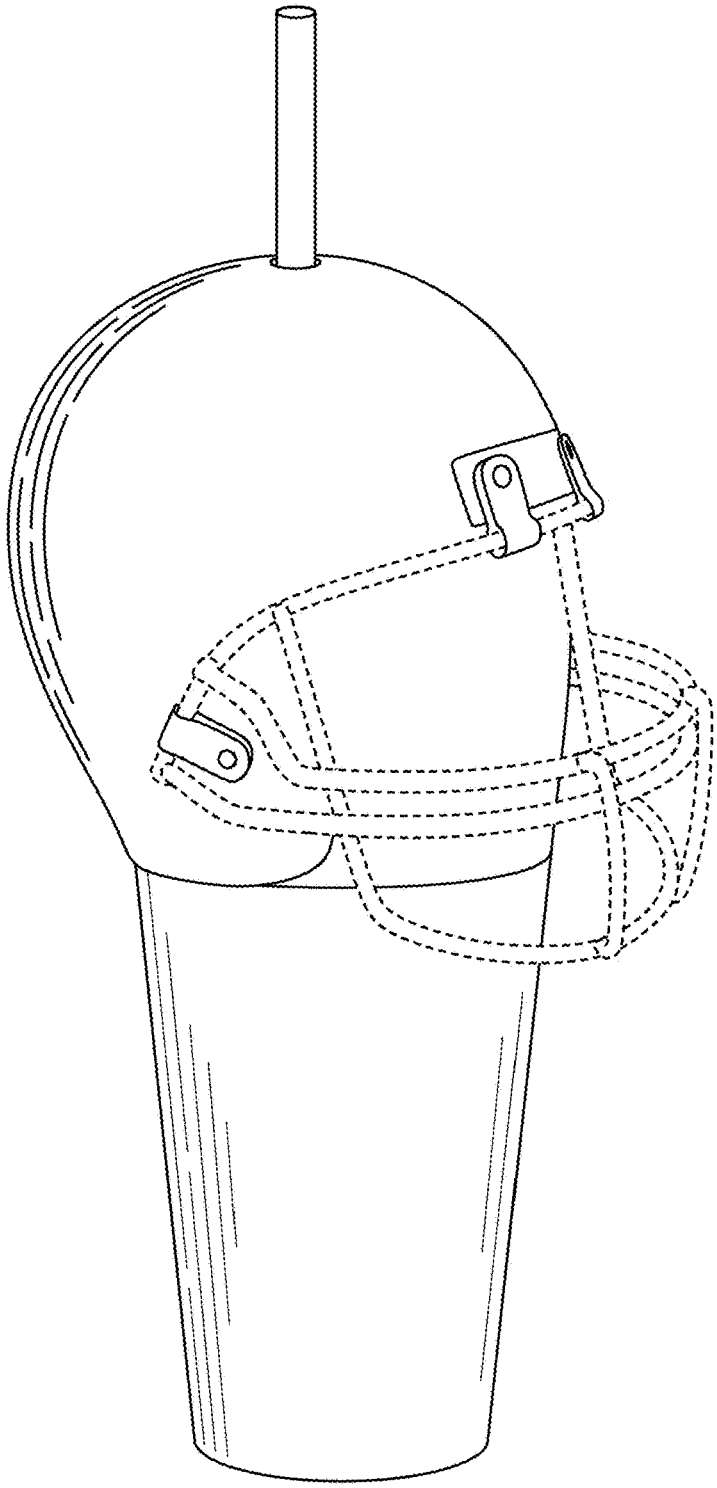
Figure 24:
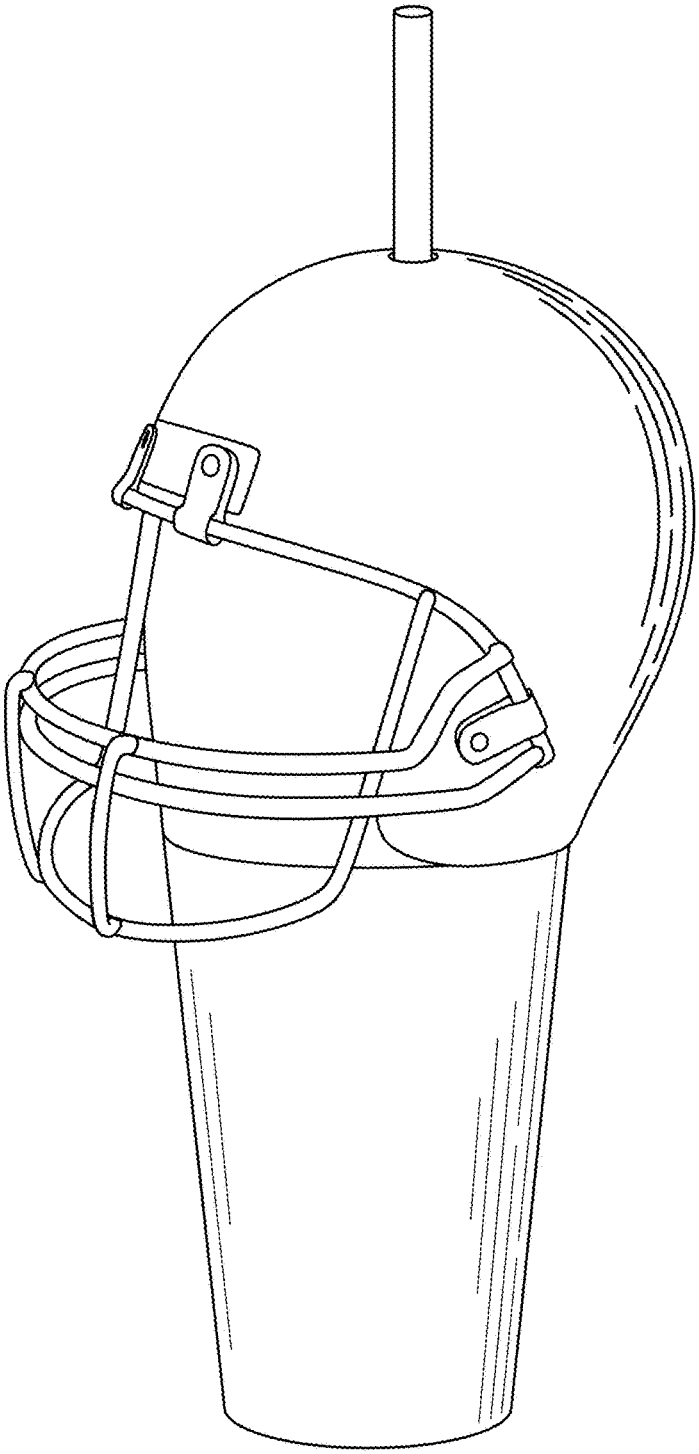
Figure 25:
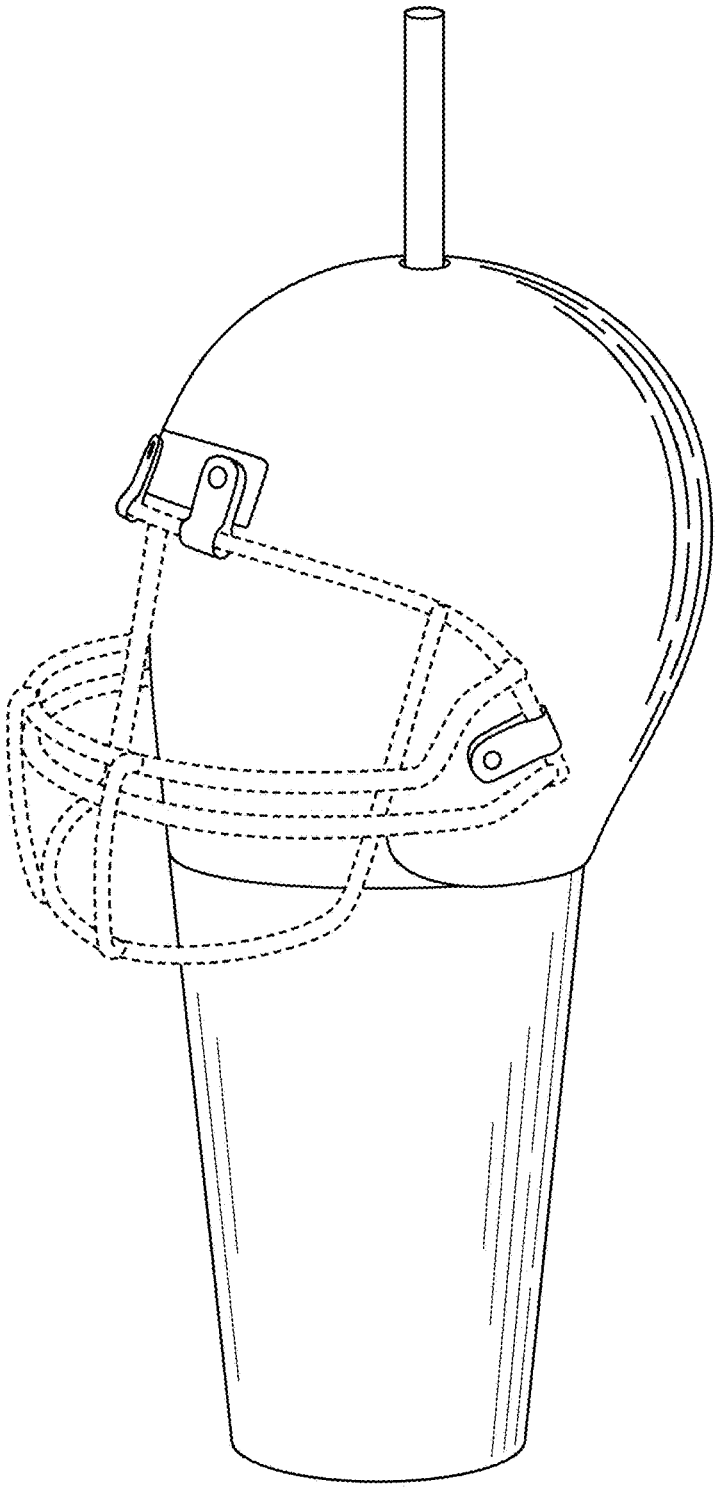
Figure 26:
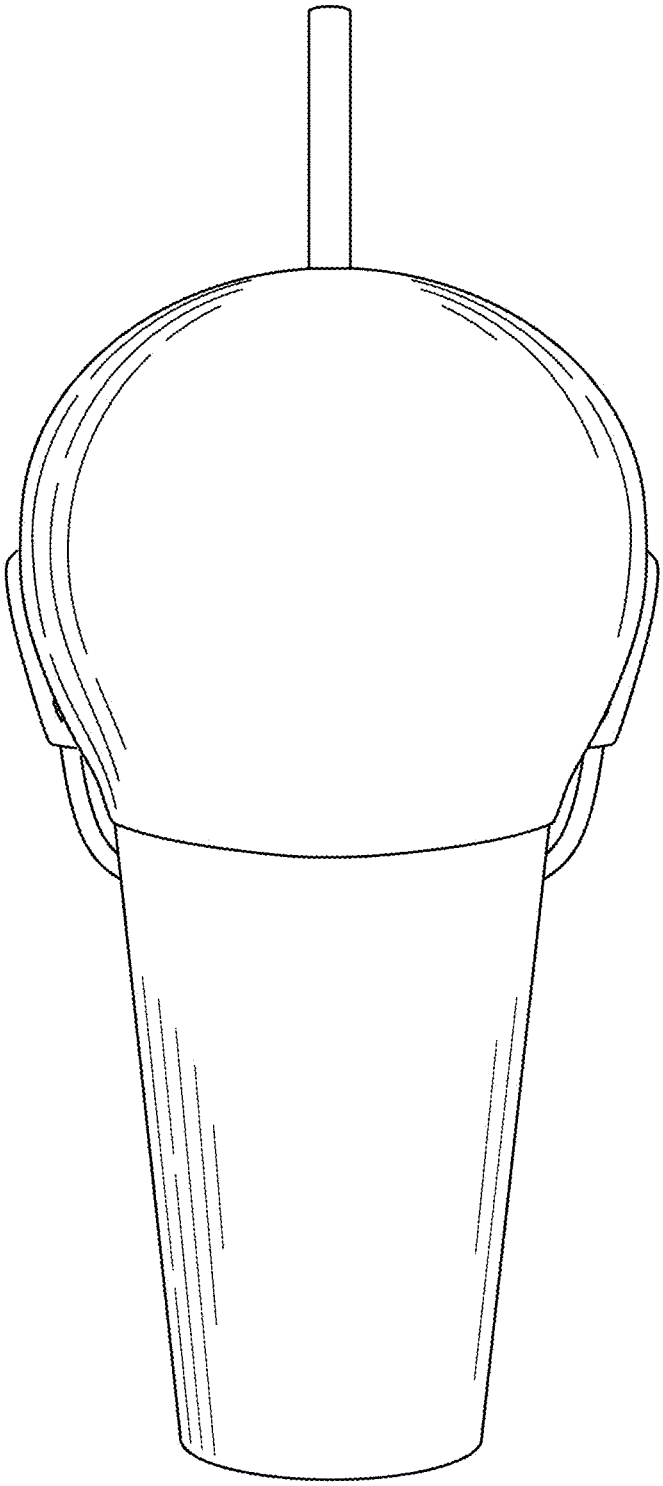
Figure 27:
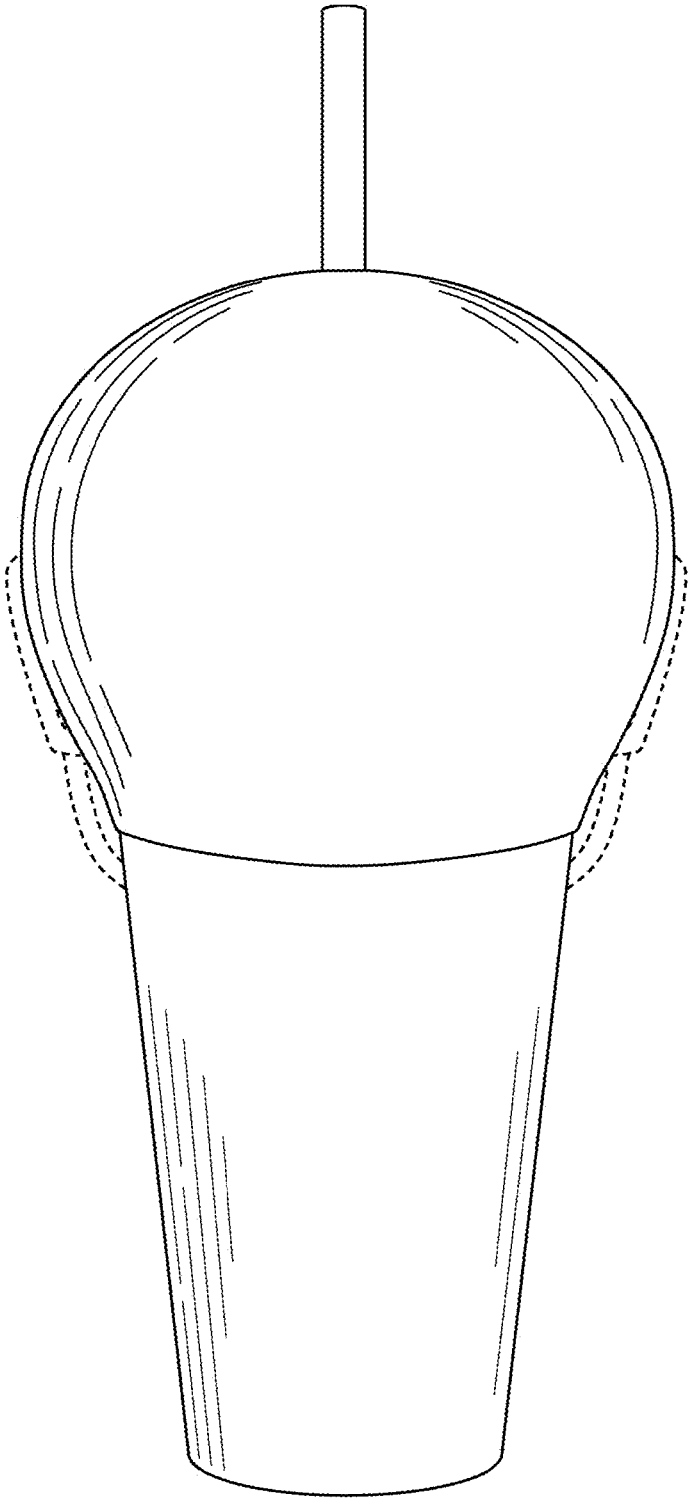
Figure 28:
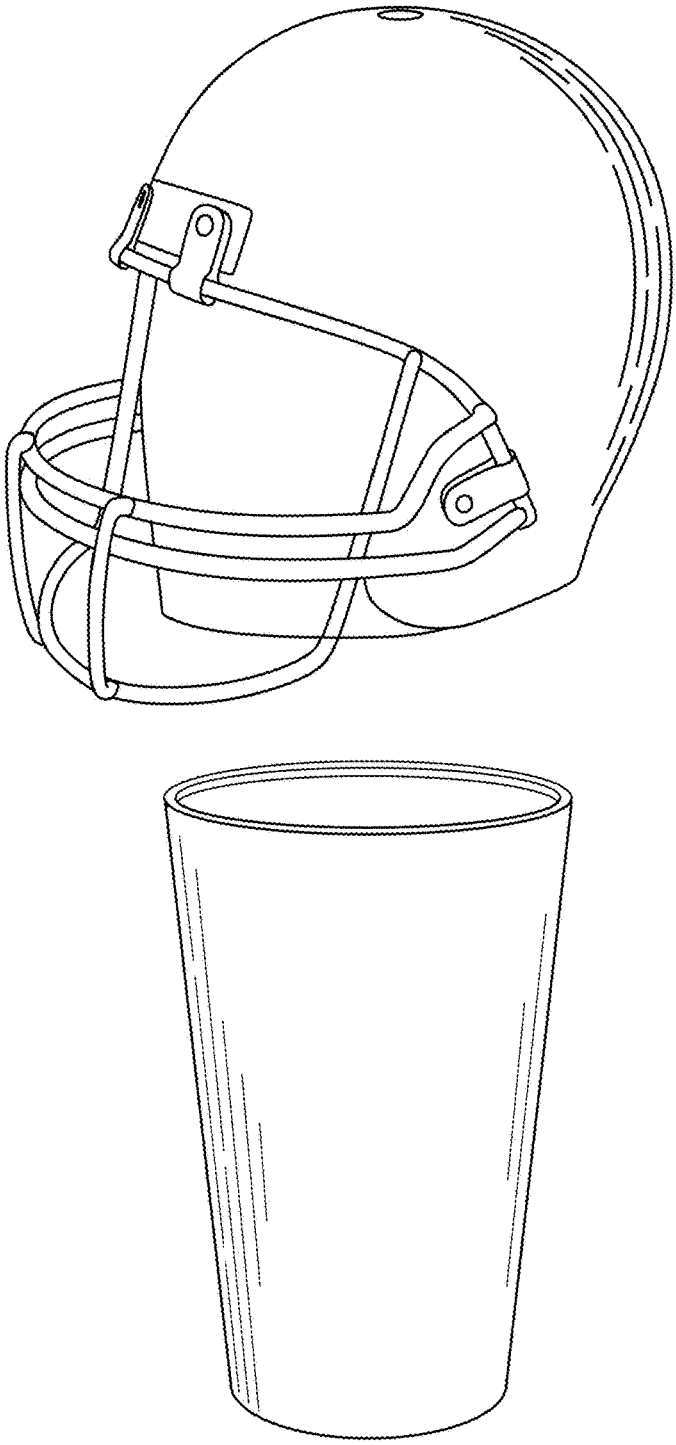
Figure 29:
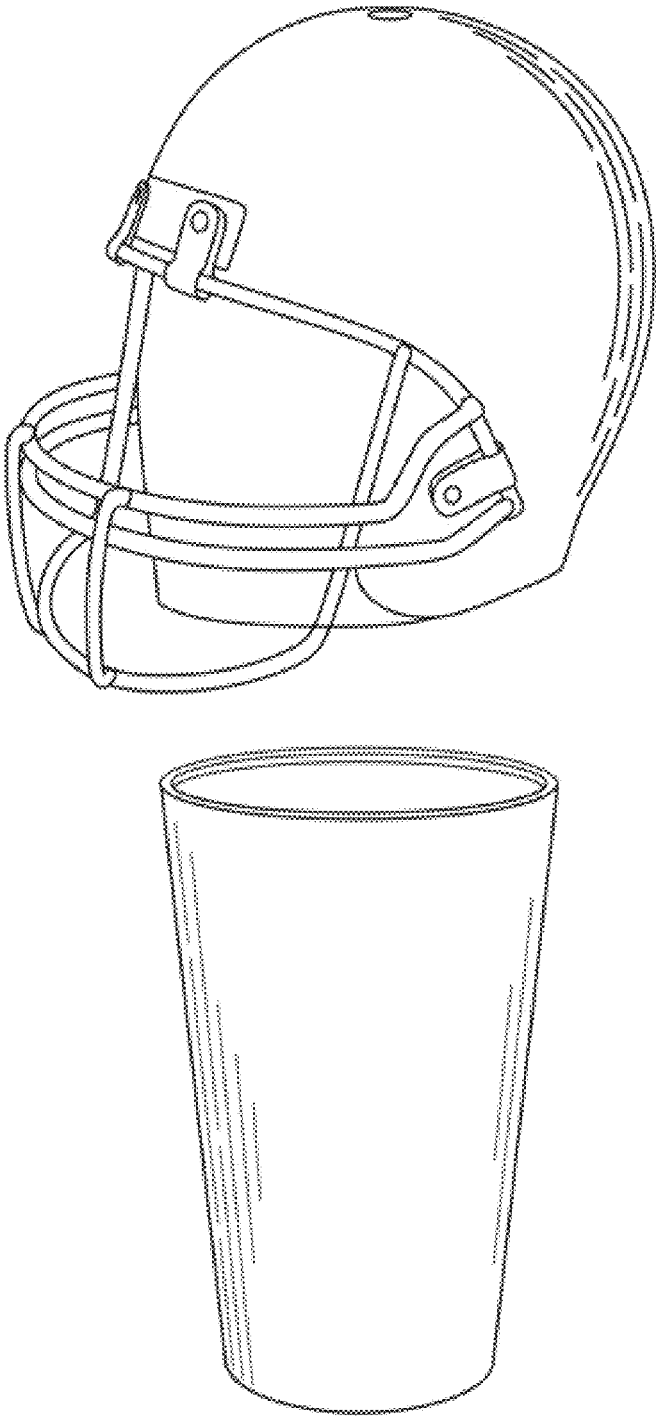
Figure 30:
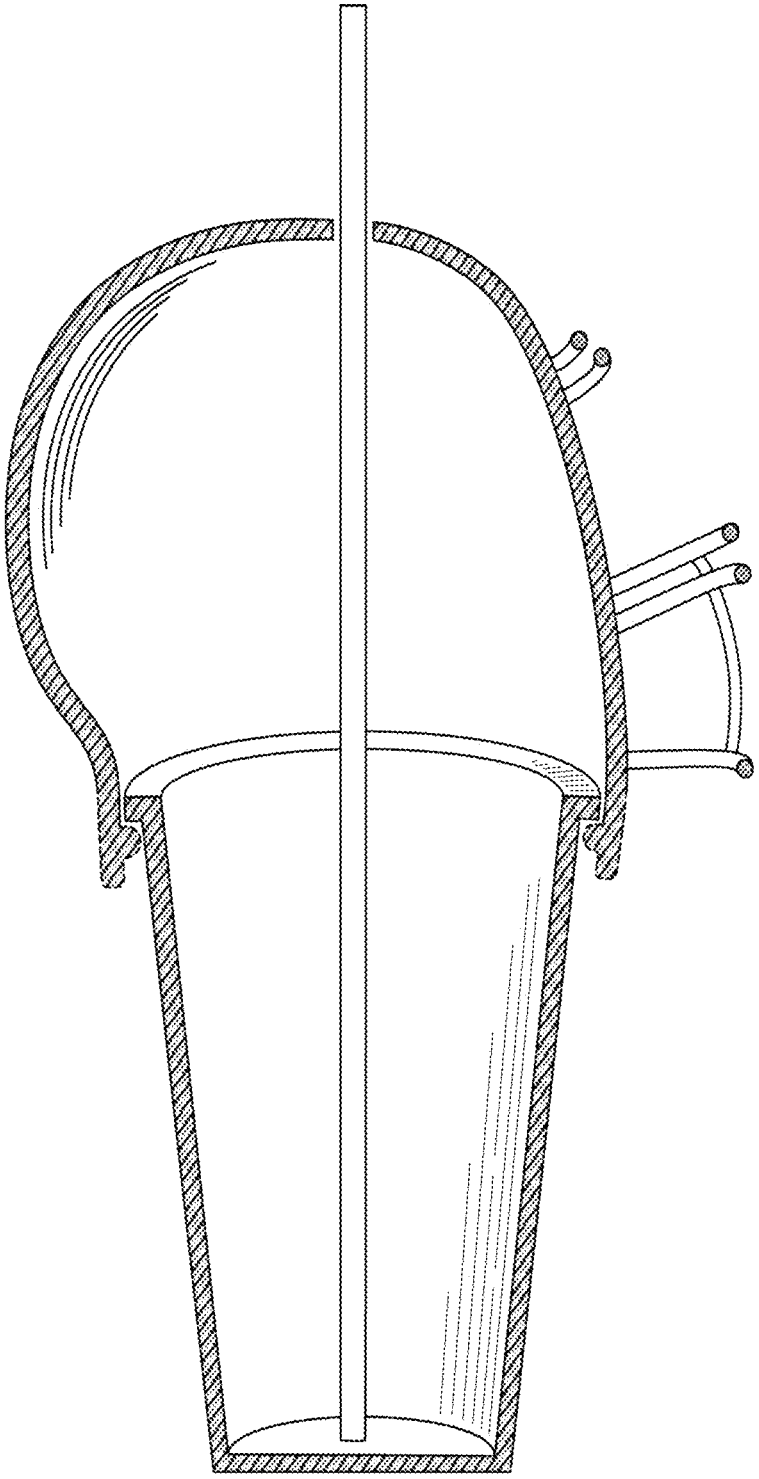
Figure 31:
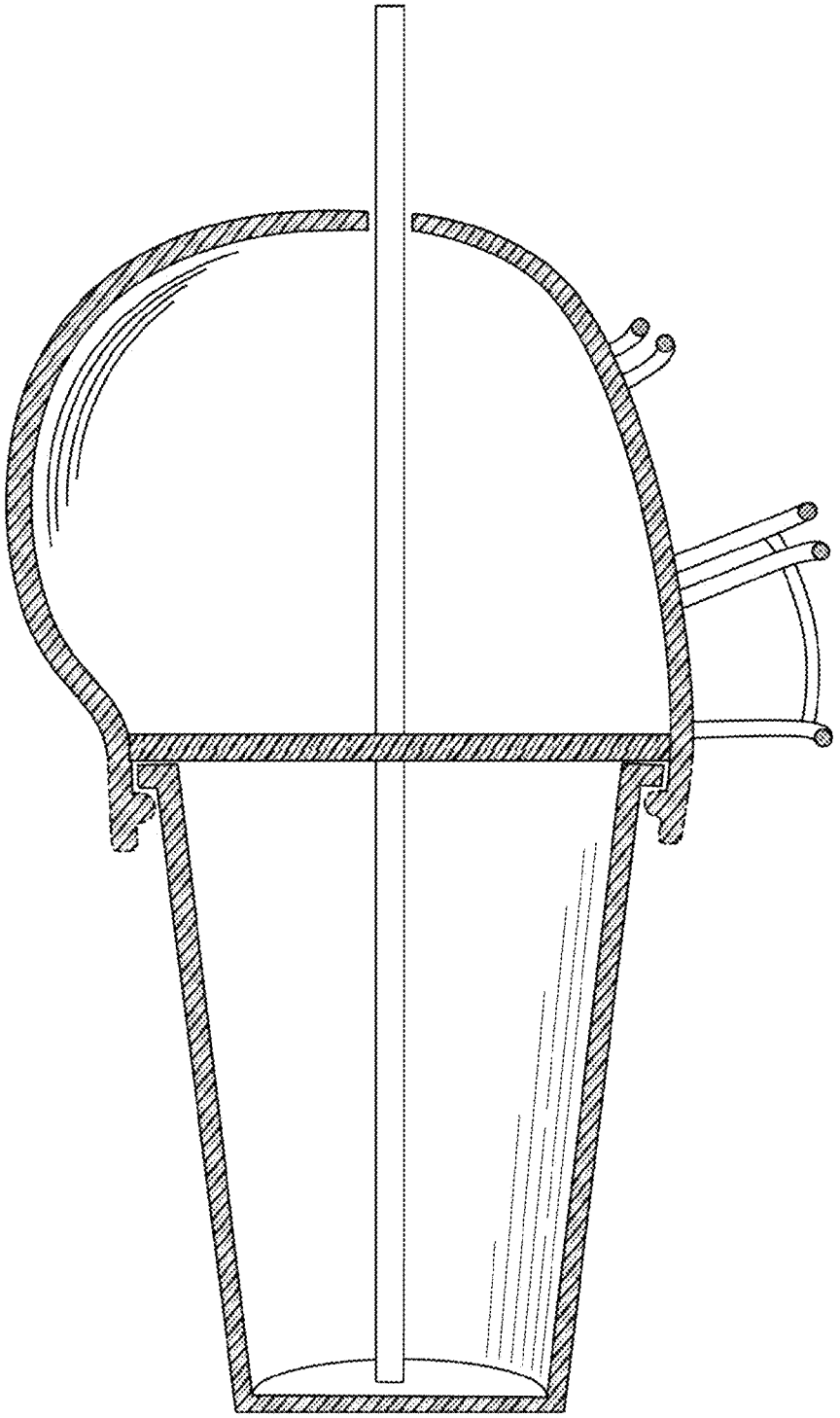
Figure 32:
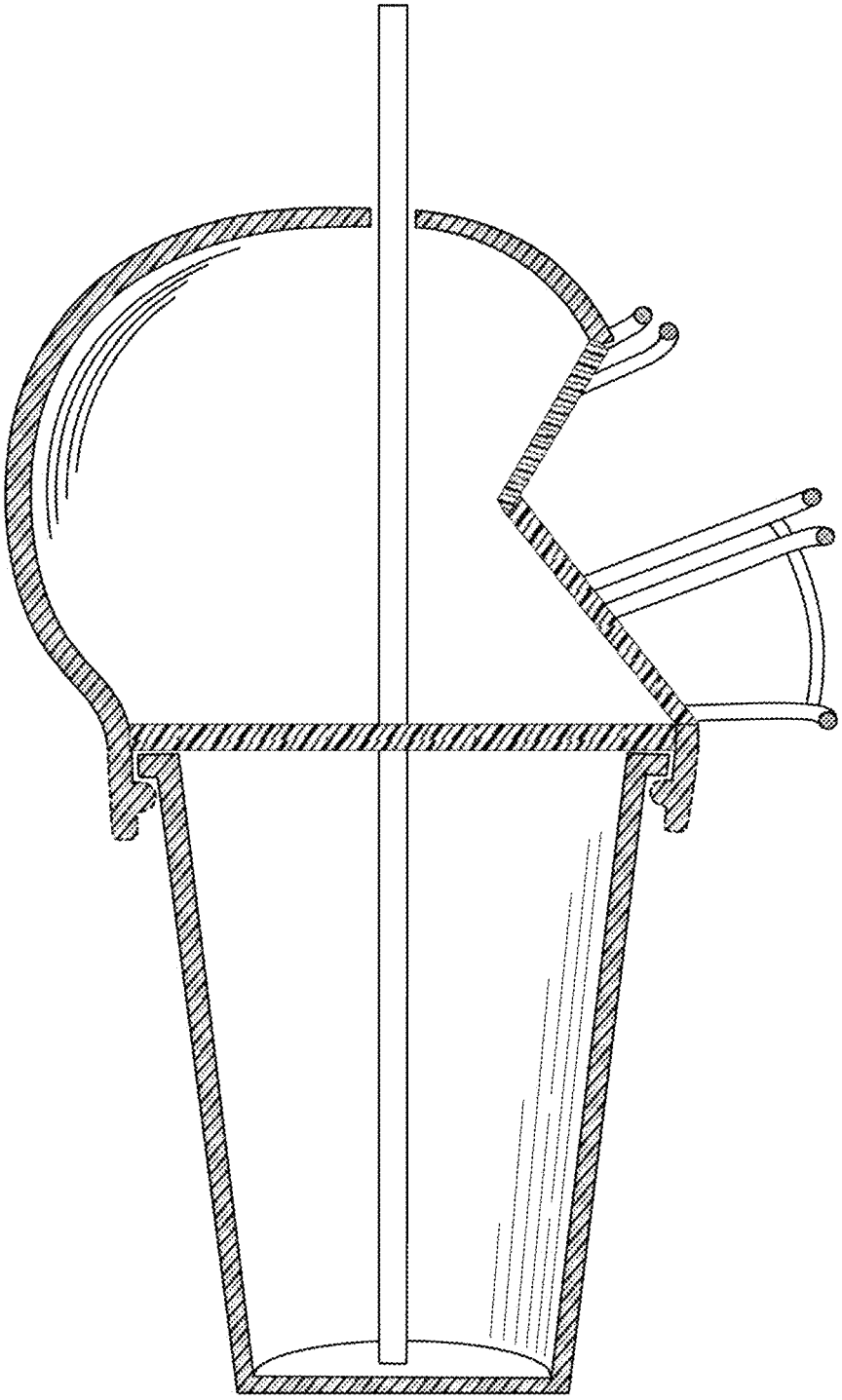
Figure 33:
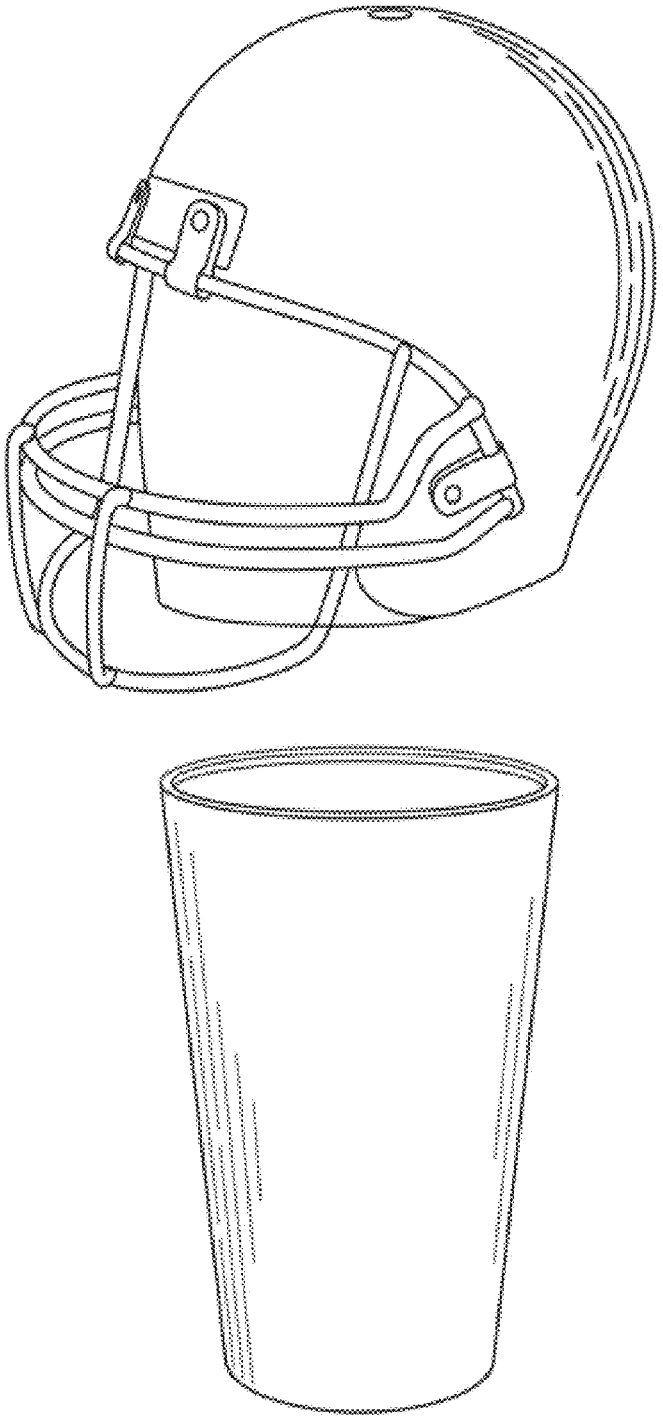
Figure 34:
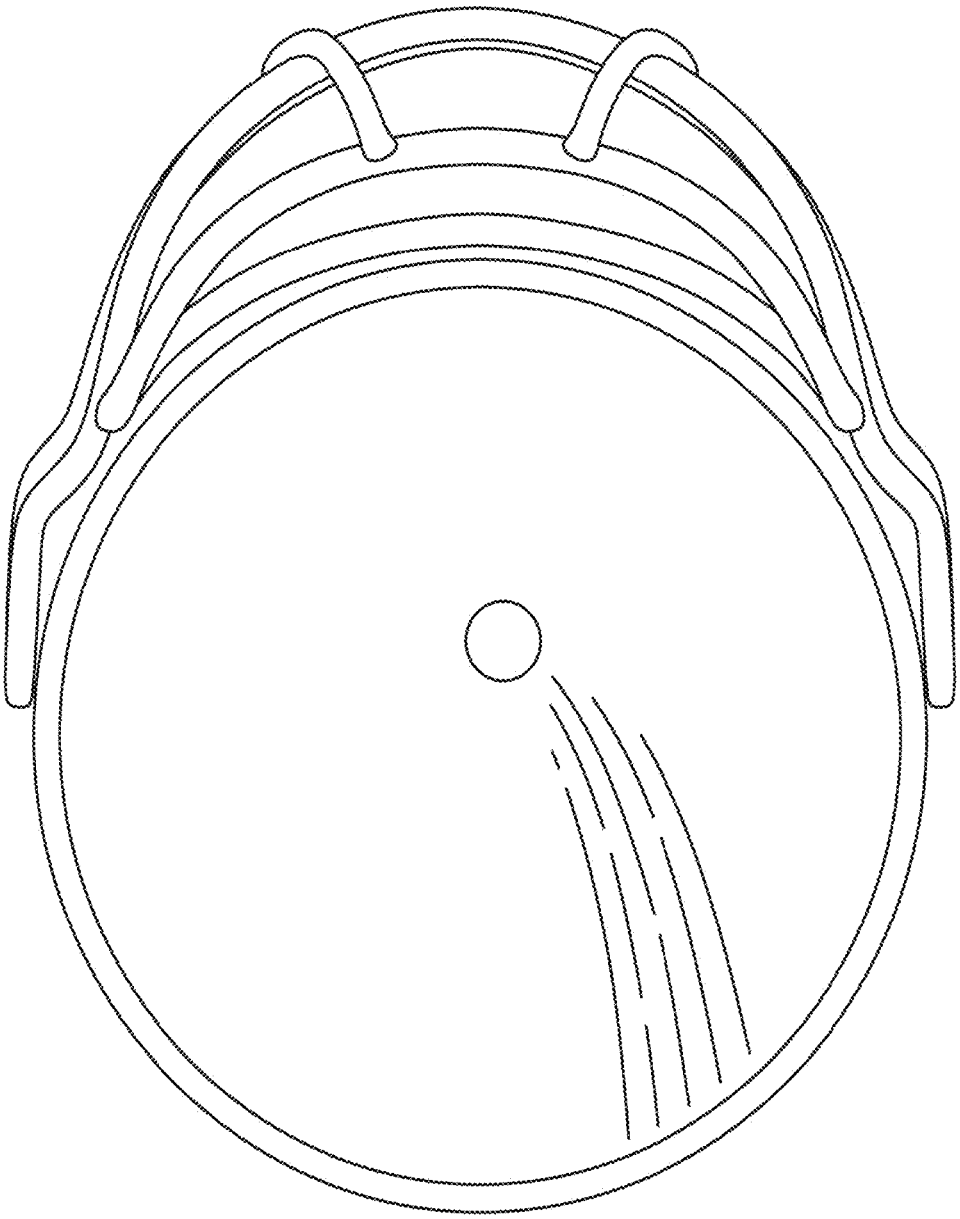

FIG. 19 illustrates a cross-sectional view of a cap lid showing a liner.

FIGS. 20-34 illustrate several views of a helmet lid.

DETAILED DESCRIPTION OF THE INVENTION

The following discussion and accompanying figures disclose a lid for a container, where the lid is embodied as a miniature baseball cap or any other type of headwear. The lid is referred to herein as cap 10 which includes many of the features or structures of a baseball cap which generally comprise a cover portion that includes a crown and a bill or visor that extends outward from the cap. The concepts and features of cap 10 that are disclosed in the following discussion may, however, be applied to a variety of lids embodied as a wide range of headwear types. Accordingly, the present invention is not limited to lids embodied as a baseball cap.

The lid having the structure of a baseball cap may also include many of the features and elements of a normal or in some cases enhanced baseball caps. The normal or enhanced features of the baseball cap will now be described.

Embodiments of cap 10 with the general structures of a baseball cap are shown in FIGS. 1-4 and include two principal elements, a cover 20 and a bill 30. Bill 30 will is sometimes referred to herein as a visor, the terms visor and bill are used within this description interchangeably. Cover 20 forms a generally hemispherical hollow cover portion which would normally cover a head of an individual, and bill 30 or visor extends outward in a substantially horizontal direction from cover 20 which would normally shade the face and eyes of an individual. The materials forming the cover 20 extend entirely around a circumference of a drinking container 31 to provide lid 10 with the appearance of a fitted baseball cap that accommodates a rim, a lip, and/or areas immediately surrounding the rim or lip of a drinking container 31 with specific rim or lip dimensions.

In some embodiments, the circumference of the opening of cover 20 of cap 10 ranges between six and one-half inches (6.5 inches) to fourteen inches (14 inches). In an embodiment of the invention, a lower edge 26 of cap 10 is configured to be mounted onto the lip or rim of drinking container 31, wherein the circumference of the lower edge 26 ranges between six and one-half inches (6.5 inches) to fourteen inches (14 inches). It will be understood that the circumference of cover 20 and/or lower edge 26 may fall outside of the above-mentioned circumference ranges and can be made to accommodate the circumference of any drinking container 31 and/or the circumference of any rim or lip of any drinking container 31. For example, a circumference of a lower portion of cap 10 may have circumferences falling within the range of one inch (1 in.) to six and one-half inches (6.5 in.) and also circumferences falling within the range of fourteen inches (14 in.) to thirty inches (30 in.) or more, depending on the size of the container. Similarly, cap 10 may be designed to accommodate the circumference of any drinking can 32 and/or any circumference of any rim or lip of any drinking can 32. It will also be understood that the range of circumferences of the opening of cover 20 or, generally, of cover 20 may be a subset of the described ranges herein. For example, an opening of a cap formed by a lower edge of the cap may be stretchable to accommodate rim or lip circumferences of a drinking container within a subset range of nine inches (9 in.) to ten inches (10 in.). Additionally, in some embodiments, the annular opening of cap 10 formed by lower edge 26 may also be configured to accommodate a drinking container with a standard lid that was previously affixed to the lip or rim portion of the drinking container. In such an embodiment, cap 10 may be affixed to the drinking container by placing the annular opening at lower edge 26 of cap 10 onto the standard lid such that at least a portion of the standard lip is in contact with interior surface 23 or the band of cap 10.

Cover 20 includes a plurality of panels 21 that are attached together along abutting sides. As shown in FIGS.

1-4, however, cover 20 includes six panels 21*a*-21*f*. More specifically, cover 20 includes two front panels 21*a* and 21*b* that are located adjacent to bill 30, two side panels 21*c* and 21*d* that are located on a left side and a right side of lid 10, respectively, and two rear panels 21*e* and 21*f* that are located in a rear of lid 10. The various panels 21 define an exterior surface 22 and an opposite interior surface 23. It will be understood that lid 10 may comprise any number of panels for forming the cover 20 including one panel. A portion of cover 20 may also include one or more and/or a plurality of eyelets 32, where one or more eyelets may be positioned on one or more of the panels 21. Eyelets 32 may be used as decorative features and/or in some alternative embodiments, eyelets 32 may also be used to vent. For example, in some embodiments, cap 10 may be used to cover a drinking container with a warm to hot substance, such as coffee. In such an example, heat stemming or rising from the coffee may vent through the eyelets 32.

Panels 21 are formed of some type of textile material and in some instances the textile material incorporates elastomer fibers or some type of elastic material. In some embodiments, panels 21 are formed of elastic material and will deform in the presence of a tensile force, thereby stretching to accommodate drinking containers with various rim or lip dimensions. The elastic material may be any material with the ability to substantially return to an original size and shape following deformation. Accordingly, sheets of elastomeric polymer materials are suitable.

Although rim or lip dimensions may vary in many respects, the circumference of the rim or lip of a drinking container 31 is the specific rim or lip dimension that regularly determines whether a particular lid will fit properly. Accordingly, the circumference of cover 20 is a primary factor in determining whether lid 10 fits upon a drinking container.

The inherent tension in the cover 20 of lid 10 ensures that lid 10 remains securely positioned on a drinking container. Although elastic material may be selected to provide sufficient tension in lid 10 for ensuring secure positioning, a strip 24 of another elastic material is located around at least a portion of the cover 20 to provide additional tension for securing lid 10 to a lip or rim of a drinking container. More specifically, strip 24 is attached to a flap 25 that extends upward along interior surface 23 and from a lower edge 26 of cover 20. An absorption band 27, which may be formed of a textile material with one or two directions of stretch. The material forming absorption band 27 may also be selected to absorb any amount of liquid that spill outside of the rim or lip of a drinking container.

In accordance with one feature of the present invention, a preformed opening 28 is provided on lid 10 to enable drinking from a drinking container 31 by, in some instances, receiving a tube or straw (not shown) through the preformed opening 28 and without removal lid 10. Preformed opening 28 may be annular in configuration so that conforming tubes or straws may pass through said performed opening 28 with ease. Preformed opening 28 may be located at or on any portion of exterior surface of lid 10. As such, a preformed opening may be located any panel 21 of lid 10. Although lid 10 only shows one preformed opening 28, lid 10 may comprise any number of preformed openings such that a user may insert more than one straw through lid 10 for drinking by multiple users from drinking container. Further, preformed opening 28 may be formed such its opening allows a straw or tube to be inserted through cap 10. Thus, preformed opening 28 is an opening that is void of material comprising cap 10, either on the exterior surface 22 or interior surface 23 of cap 10. In addition, preformed opening 28 is separate from and different than eyelet 32. Whereas eyelet 32 is sufficiently sized for venting cap 10 and/or used as a decorative feature of Cap 10, eyelet 32 is not configured and/or useable for receiving a straw or tube for drinking as is preformed opening 28. Preformed opening 28 may be sized sufficiently for receiving a straw or tube for drinking the contents of a drinking container 31 on which cap 10 has been securely positioned as a lid. For example, a user of cap 10 upon securing cap 10 onto a drinking container 31, insert a straw through preformed opening 28 and then directly into the substance of a drinking container 31 such that the user may successfully drink, using the straw or tube, the substance or content of drinking container 31.

In accordance with another feature of the present invention, a hole cover 29 is provided and affixed to exterior surface of lid 10, hole cover 29 being useable to seal or cover the preformed opening 28 of lid 10. Hole cover 29 may, in some embodiments, be affixed to exterior surface of lid 10 proximate to preformed opening 28 such that a user of lid 10 may uncover or re-cover preformed opening 28 with hole cover 29.

In accordance with yet another feature of the present invention, a skirt 30 is provided that extends substantially downward from the edge of cover 20 to further secure cover 20 onto a rim or lip of a drinking container. In some embodiments, the skirt 30 stretches downward from the entire edge of cover 20 in an annular form which is substantially concentric with the circumference of cover 20 formed by its edge. Skirt 30 is formed of a stretchable material configured to conform to the shape of the rim or lip and/or in some instances, the area below the rim or lip of a drinking container.

In some embodiments of the present invention, cap 10 comprises a liner 33 that, in many instances, forms a substantially impermeable or fully impermeable layer. Liner 33 may be positioned or affixed to the interior surface 23 of cap 10. The purpose of liner 33 being to prevent moisture, fluids, or many types of absorbable liquids from coming into contact with interior surface 23 of cap 10. Liner 33 may be formed of any water-resistant material or barrier-forming material including, but not limited to, waterproof fabrics, synthetic fabrics laminated or coated with a waterproofing material such as rubber, polyvinyl chloride, polyurethane, silicone elastomer, fluoropolymers, wax, and the like. In some embodiments, interior surface 23 of cap 10 is formed of a material which includes water-resistant or an impermeable material of the types describe herein. In such an embodiment, liner 33 may not be necessary.

Military Style Drink Cup Cap

FIGS. 10-12 illustrate a military style cap 11. Cap 11, in some embodiments, comprises substantially the same elements has the various embodiments of cap 10 above. Cap 11 is configured such that it may have and benefit from any feature described herein.

The present invention is disclosed above and in the accompanying drawings with reference to a variety of embodiments. The purpose served by this disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

FIG. 20-34 illustrate a helmet cap. The helmet cap includes a front mask that is securedly fastened to a helmet using mechanical fasteners, such as screws or the like. The helmet cap is generally shaped as a football helmet having a straw hole at a portion of its surface. In the interior of the helmet cap includes a circumferentially extending tube which extends from an interior section or surface of the helmet portion and downward towards an opening or lower section of the helmet cap. A portion of the grill of the mask of the helmet cap extends lower than the circumferential tube. The circumferential tube has an opening with a circumference sufficiently large to accommodate an opening of a drinking container. The helmet cap shares many of the same features and functions as many or all of the embodiments described herein. The circumferential tube may be positioned flush to the rear of a bottom portion of the helmet. Additionally, as shown by way of example in FIG. 30, one embodiment of the present application includes a lid and a drinking container, the lid comprising: a helmet-shaped portion having a grill having a shape of a football face guard; a tube that: (i) is located through a preformed opening at a crown of the helmet-shaped portion, (ii) has an opening at a distal end of the tube that is opposite a proximal end of the tube located at the preformed opening, wherein the distal end extends to a point within the drinking container that is past a lowest position of the helmet-shaped portion, wherein the helmet-shaped portion having a lower opening, the lower opening attached to a top portion of the drinking container thereby covering the drinking container.

What is claimed:

1. A lid and a drinking container, the lid comprising:

a helmet-shaped portion having a grill having a shape of a football face guard;

a tube that: (i) is located through a preformed opening at a crown of the helmet-shaped portion, (ii) has an opening at a distal end of the tube that is opposite a proximal end of the tube located at the preformed opening, wherein the distal end extends to a point within the drinking container that is past a lowest position of the helmet-shaped portion, wherein the helmet-shaped portion having a lower opening, the lower opening attached to a top portion of the drinking container thereby covering the drinking container.

* * * * *